US008695293B2

(12) United States Patent
Teodorovich

(10) Patent No.: US 8,695,293 B2
(45) Date of Patent: Apr. 15, 2014

(54) DOOR AND WINDOW SILL PAN FLASHING WITH EXTENSION COUPLER

(76) Inventor: Mishko Teodorovich, Austin, TX (US)

( * ) Notice: Subject to any disclaimer, the term of this patent is extended or adjusted under 35 U.S.C. 154(b) by 0 days.

(21) Appl. No.: 13/400,461

(22) Filed: Feb. 20, 2012

(65) Prior Publication Data

US 2012/0144761 A1 Jun. 14, 2012

Related U.S. Application Data

(63) Continuation-in-part of application No. 12/372,232, filed on Feb. 17, 2009, now Pat. No. 8,117,789, which is a continuation-in-part of application No. 10/730,414, filed on Dec. 8, 2003, now abandoned.

(60) Provisional application No. 60/497,078, filed on Aug. 22, 2003, provisional application No. 60/507,915, filed on Oct. 1, 2003.

(51) Int. Cl.

| | |
|---|---|
| ***E06B 1/70*** | (2006.01) |
| ***E06B 7/14*** | (2006.01) |
| ***E06B 1/04*** | (2006.01) |
| ***E04D 1/36*** | (2006.01) |

(52) U.S. Cl.

CPC .... *E06B 1/70* (2013.01); *E06B 7/14* (2013.01)
USPC ..... 52/209; 52/210; 52/60; 49/471

(58) Field of Classification Search

CPC ..... E06B 1/70; E06B 1/702; E06B 1/705; E06B 1/6092; E06B 7/14
USPC ..... 49/467, 468, 471; 52/204.5, 209, 52/204.54, 204.56, 58, 212, 210, 60, 211, 52/204.53, 217
See application file for complete search history.

(56) References Cited

U.S. PATENT DOCUMENTS

| | | | | |
|---|---|---|---|---|
| 1,904,404 | A * | 4/1933 | Burk | 52/62 |
| 2,697,932 | A * | 12/1954 | Goodwin | 52/97 |
| 4,555,882 | A * | 12/1985 | Moffitt et al. | 52/209 |
| 6,098,343 | A * | 8/2000 | Brown et al. | 52/11 |
| 6,371,188 | B1 * | 4/2002 | Baczuk et al. | 160/92 |
| 6,385,925 | B1 * | 5/2002 | Wark | 52/209 |
| 7,222,462 | B2 * | 5/2007 | Ellingson | 52/62 |
| 2005/0144865 | A1 * | 7/2005 | Ellingson | 52/272 |
| 2005/0217189 | A1 * | 10/2005 | Moffitt | 52/209 |

* cited by examiner

*Primary Examiner* — Ryan Kwiecinski
(74) *Attorney, Agent, or Firm* — Rick B. Yeager

(57) ABSTRACT

A window sill pan flashing or a door sill pan flashing with drain. The sill pan flashing has an inclined base, and window or door continuous or near continuous sill supports which can be extruded as part of the base unit. Sill pan flashing offsets provided in the rear sill pan flashing wall and in the front flange create a flow path for water to drain from the sill pan flashing to the exterior of the building. The base may be solid or hollow with window or door supports extending vertically through the base. Extension couplers are provided to join a plurality of sill pan flashing base sections. The sill pan flashing base sections and extension couplers may be manufactured by extrusion.

6 Claims, 45 Drawing Sheets

790
792
700A
794
700B
700C
796

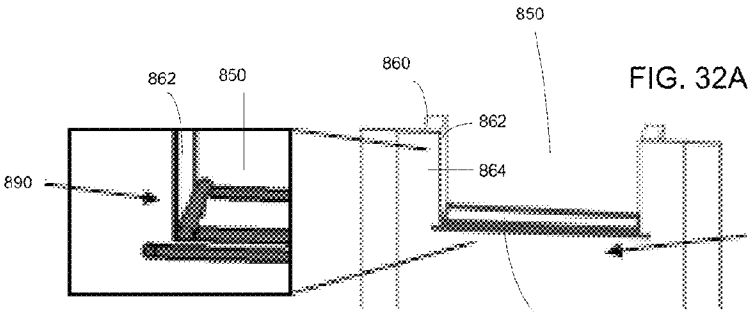
FIG. 32A
FIG. 32B
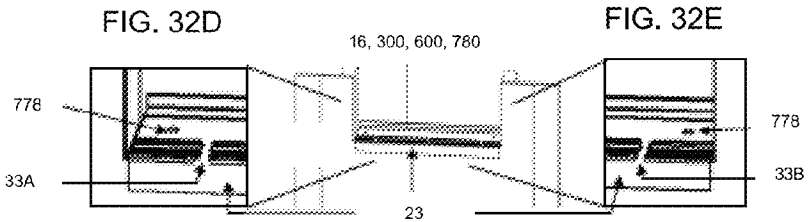
FIG. 32E
FIG. 32C
FIG. 32D
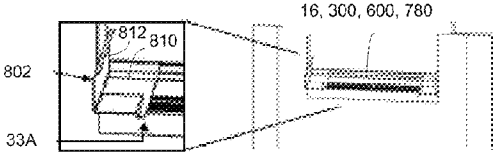
FIG. 32F
FIG. 32G

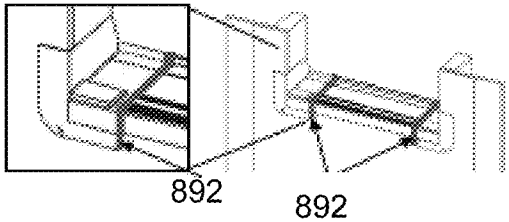
FIG. 32J
FIG. 32K
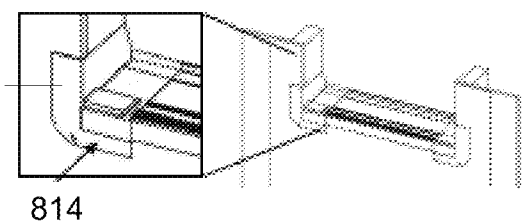
FIG. 32I
FIG. 32H
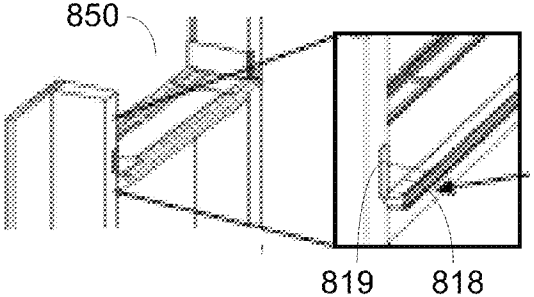
FIG. 32L
FIG. 32M

DOOR AND WINDOW SILL PAN FLASHING WITH EXTENSION COUPLER

RELATED APPLICATIONS

This application is a continuation-in-part of U.S. patent application Ser. No. 12/372,232 filed Feb. 17, 2009 and scheduled to issue as U.S. Pat. No. 8,117,789 on Feb. 21, 2012. U.S. patent application Ser. No. 12/372,232 was a continuation-in-part of U.S. patent application Ser. No. 10/730,414 which is related to and claims priority from U.S. Provisional patent application No. 60/497,078 filed Aug. 22, 2003, and U.S. Provisional patent application No. 60/507,915 filed Oct. 1, 2003.

FIELD OF INVENTION

This invention relates to a sill pan flashing for a rough opening of a door or window, where the sill pan flashing drains accumulated moisture from the entire rough opening.

BACKGROUND

In this specification and claims, the term "sill" refers to the horizontal bottom part of a window or door as defined by ASTM E 2112-07 Standard Practice for Installation of Exterior Windows, Doors, and Skylights, section 3.2.121.

In this specification and claims, the term "pan flashing" or "sill pan flashing" refers to "a type of flashing used at the base of rough opening to divert incidental water to the exterior or to the exterior surface of concealed WRB (weather-resistive barrier)," as defined by ASTM E 2112-07 section 3.2.91. As further described in Note 3 to ASTM E 2112-07:

> "sill pan flashing have upturned legs at the interior edge and ends of the rough opening to from a three-sided pan. They are intended to collect and drain water toward the exterior including water that may enter through the window unit (for example, between the jambs and sill) or around the window (between the rough opening and the fenestration). The pan flashing [or sill pan flashing] must be integrated with other flashings and the window assembly to capture water that may otherwise penetrate to the sill framing and allow it to freely drain to the exterior. The window, flashings, and pan are to be sealed in a manner that reliably inhibits air and moisture flow to the interior."

A "sill pan flashing" is different structurally and functionally from a "sill". The sill is a structural part of a window or door assembly that connects bottom of the frame (jamb) members and does not extend to the full width of a rough opening, and does not collect or drain the water that enters around the door or window unit (between the jamb and the rough opening). A sill is not integrated with the Water Resistive Barrier (WRB).

FIG. 24 is a front perspective view provided in ASTM E 2112-07 as an illustration of the sill pan flashing.

It is desirable to provide a relatively low cost sill pan flashing for the entire rough opening to be installed underneath window and door sills for directional drainage of water and moisture which can be used for construction in all price ranges of housing, and for any door or window width. In one embodiment of the current invention, a base unit is provided which can be manufactured by extrusion and either cut to a desired length to fit the door or window width opening, or used with other similar elements and connectors to establish a desired final length. End pieces and optional center joining elements are provided for field assembly.

The prior art includes U.S. Pat. No. 5,921,038 to Burroughs which describes a window sill pan with an inclined plate and ribs perpendicular to the front edge. The patent includes a front cover, but does not disclose end members.

U.S. Pat. No. 6,385,925 B1 to Wark teaches an inclined plate with ribs perpendicular to the front edge. The Wark patent does not include a cover, but does have end members. Wark also describes the possible use of other window support means such as truncated cones. Wark describes the supports as being on the apparently solid inclined base.

It is desirable to provide a sill pan flashing that can be used for doors or windows of any length. It is desirable to provide an economical sill pan flashing that can be used in most construction. One way to provide a relatively low cost device is to extrude the base. It is desirable in such applications to provide window or door supports which can be extruded in relatively long lengths suitable to be cut in the field in order to accommodate different size windows and doors. It is desirable to extrude a unit which includes door or window supports in order to avoid attaching separate support elements to a base unit.

It is desirable to manufacture window and door sill pan flashing elements in an efficient and economical extrusion process, to supply the elements in relatively long lengths, and to cut the elements to a desired length at a construction site. This manufacturing and installation method may provide sill pan flashing units that are more readily available to builders and which are more economical that purchasing prefabricated sizes from a supplier who is required to stock a large number of possible widths. This manufacturing and installation method eliminates the need for special ordering of sill pan flashings for different field dimensions.

Also, if an injection molding tool were required for each size, then relatively high volumes of each size would be required to pay for the tool. It is difficult to order and store many different sizes of sill pan flashing for the variety of window and door dimensions which are used in construction. By designing the sill pan flashing for manufacture by extrusion, a single extrusion tool and a single injection molding tool for end pieces can provide sill pan flashing of a variety of lengths. In some embodiments, sections of base may be connected to establish a desired length. In other embodiments, the base may be cut to a desired length.

SUMMARY

The current invention is for a window sill pan flashing or door sill pan flashing. In some embodiments of the current invention, the device can be made in a low cost manufacturing operation by extrusion. In one embodiment, SureSill™ is made by combining extrusion and injection molding processes. The sill pan flashing typically includes an inclined base, window or door supports which can be extruded as part of the base unit, and corner elements which can be snapped or otherwise attached to the base.

In some embodiments, the base may be solid. In other embodiments, the base may be hollow with window or door supports extending vertically through the base. In the case of fiberglass construction, the base may include a slanted upper face, but no lower face.

In one embodiment, the sill pan flashing has offsets provided in both a rear sill pan wall and in a front flange. These offsets create a flow path for water to drain from the rough opening.

In one embodiment, the sill pan flashing includes corner side flanges that are preferably provided without openings, and the sill pan flashing is secured in a window or door opening by stapling across a corner of the side flange, by bending a nail over the flange, or by nailing through the flange.

In some embodiments, the window support means is provided in a horizontal orientation so that the base can be extruded. In other embodiments, the base may be fabricated from fiberglass, metal, or molded plastic, and may not have a horizontal orientation.

In other metal or plastic embodiments, the sill pan flashing is provided as a center piece that can be cut to a desired length, and as end elements that can be snapped or glued to the center piece.

In one embodiment, an extruded base unit is cut to a desired length, and an installation tolerance is provided in corner units which slide onto the base unit.

In another embodiment, a base unit is provided in two or more sections which slidably overlap in a manner that compensates for rough framing tolerances, so that the sill pan flashing can be adjusted to cover the entire rough opening width.

BRIEF DESCRIPTION OF THE DRAWINGS

These and other objects and advantages of the present invention are set forth below and further made clear by reference to the drawings, wherein:

FIGS. 32A-32M illustrate an example installation of ESAF flashing over a sill pan flashing.

DETAILED DESCRIPTION OF EMBODIMENT

Plastic Sill Pan Flashing with Extruded Base Cut to Desired Length

Figure 1:
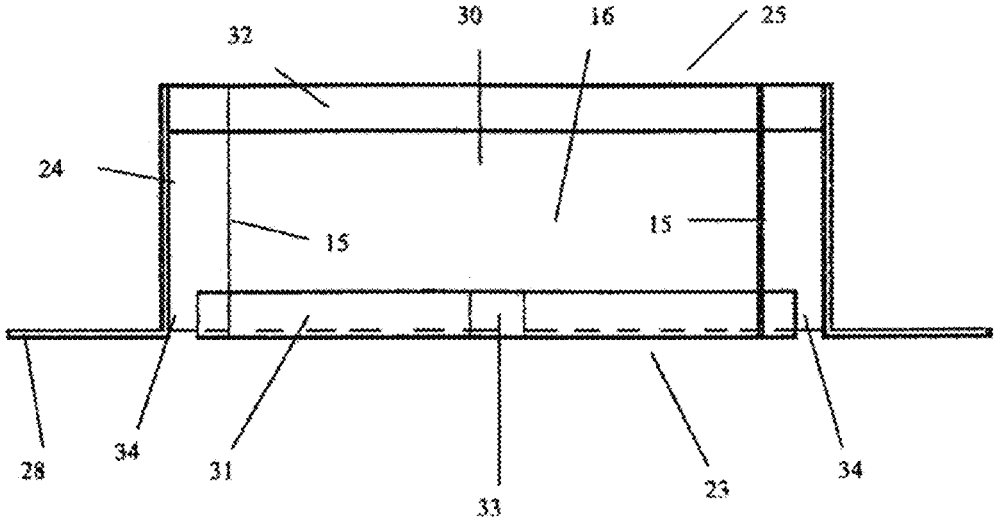
FIG. 1 is a top view of an embodiment of the invention

Referring now to FIG. 1, which is a top view of a single sill pan flashing, the sill pan flashing includes a base 30 with a downwardly sloping top surface. The sill pan flashing has a front support ridge 31 and a rear support ridge 32 for supporting a window or door. The window or door typically includes a horizontal sill which is supported by the sill pan flashing of the current invention. In this embodiment, the sill pan flashing includes an extruded middle piece 16, or lock-in channel plate, and end pieces 15, or, lock-in corners, which may be molded or provided by other manufacturing processes. Pieces are typically joined with cement such as PVC glue or with a snap together feature.

Figure 2:
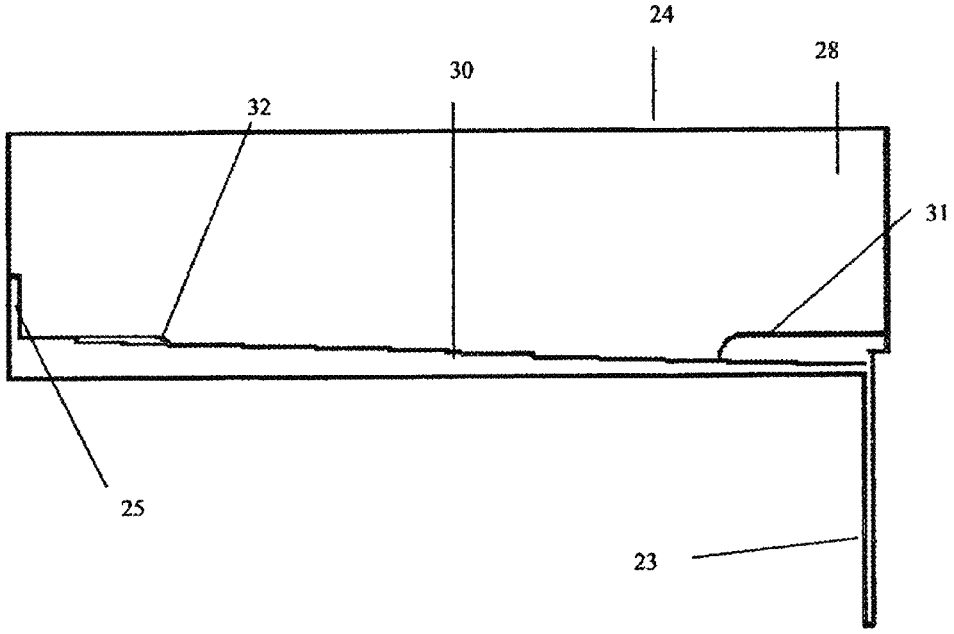
FIG. 2 is a side cross section view of the embodiment of FIG. 1.

Referring now to FIG. 2 which is a side view of the sill pan flashing embodiment of FIG. 1, the base 30 has a slope from the rear portion of the sill pan flashing to the front portion The front support ridge 31 is solid through the base so that it rests on the bottom and the rear support ridge 32 is also solid, thereby transmitting the weight of the window or door to the support area for the sill. Wall thickness for the walls can be approximately ⅛ of an inch thick. In one embodiment the front support pedestal has a width of approximately ¾ of an inch, and the rear support pedestal has a width of approximately 1 inch.

As shown in the FIGS. 1 and 2, this embodiment includes a rear wall 25 and a downward extending lip 23. The rear wall may include offsets (not shown) to provide a drain path between the rear wall and the window or door. The downward extending lip 23 may include an offset to provide a drain path between the sill pan flashing and the siding or other materials installed around the window or door. These offsets create a drain path for moisture which might become present in the rough opening.

In this embodiment the front ridge may further include a gap 34 between the support ridge and the sides and may further include a drain channel 33 to permit the drainage of moisture. The corner pieces include a side upward lip 24 and a downward lip 23.

Figure 3:
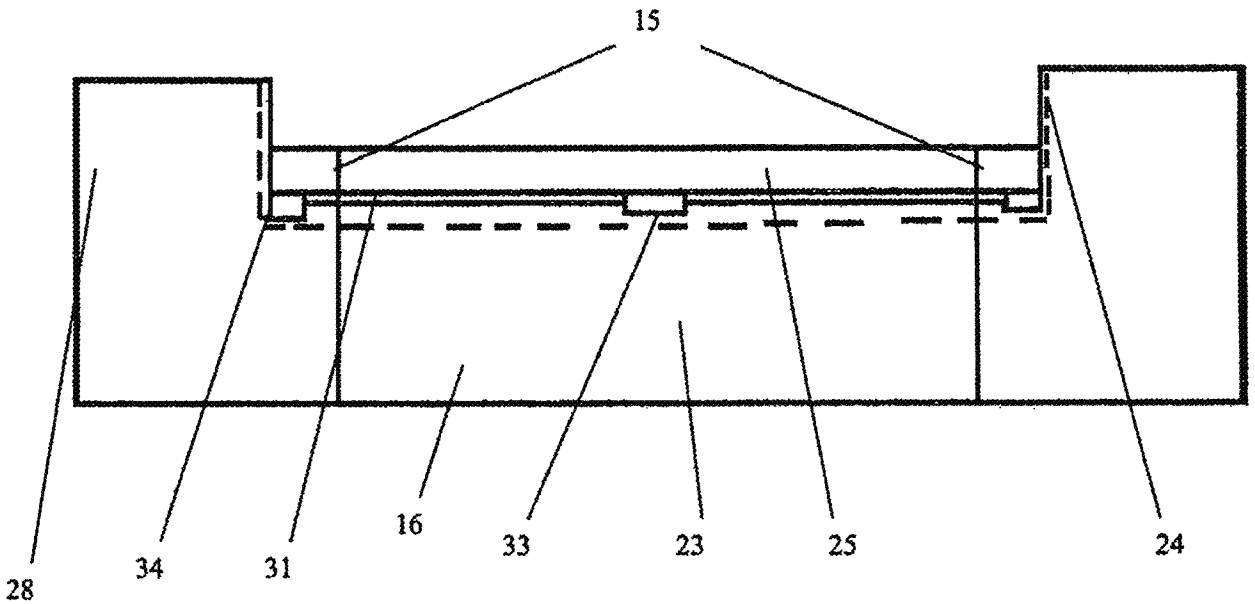
FIG. 3 is a front view of the embodiment of FIG. 1.

Referring now to FIG. 3 which is a front view of the embodiment of FIG. 1, the front support ridge 31 includes gaps 33 and 34 for drainage.

Figure 4:
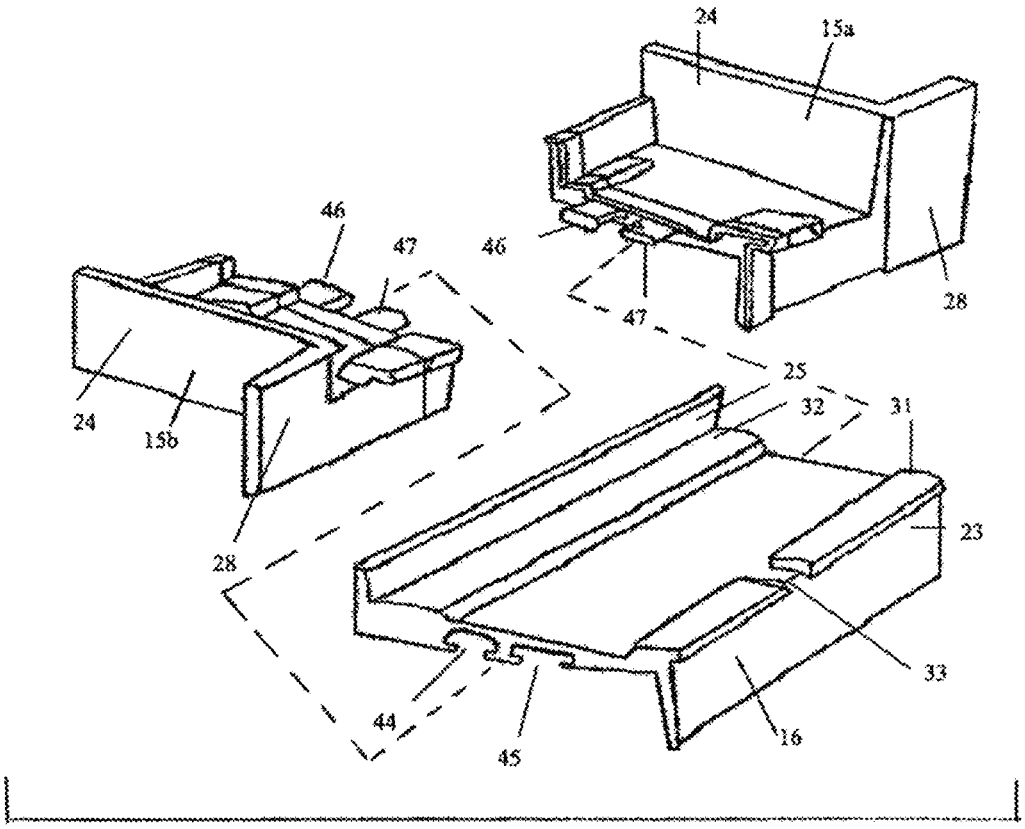
FIG. 4 is an exploded view of an embodiment with a base element and corner elements.

FIG. 4 is an exploded view of an embodiment with a base element and end elements. In this case the extruded middle piece 16 includes a first channel 44 and a second channel 45. The right corner element 15A includes a first tab 46 which fits into the first channel 44, and a second tab 47 which fits into the second channel 45. The left corner element 15B also includes a first tab 46 which fits into the first channel 44, and a second tab 47 which fits into the second channel 45. The tabs and channels create an interlocking between the middle piece and the corner elements.

Figure 5:
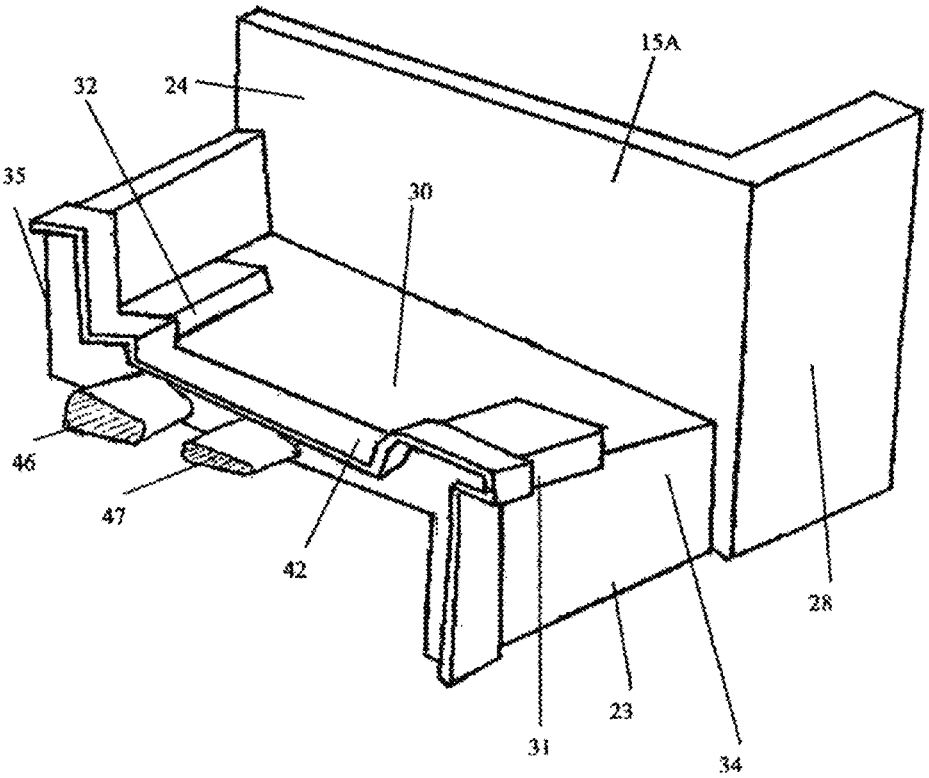
FIG. 5 is an enlarged detail perspective view of the right end element of the embodiment of FIG. 4.

FIG. 5 is an enlarged detail view of the right end element 15A of the embodiment of FIG. 4. In this embodiment, the corner element includes a first tab 46 or alignment extension which may be inserted into the first channel 44 in the base portion; a second tab or alignment extension 47 may be inserted into the second channel 45 in the base portion; and an overlapping lip 42.

DETAILED DESCRIPTION OF EMBODIMENT

Method of Manufacturing Extruded Base

It is desirable to provide a relatively low cost product which can be used for construction in all price ranges of housing. In one embodiment of the current invention, a base unit is provided which can be manufactured by extrusion to a common long length, such as 16 feet, and cut to a desired length.

In this embodiment the base has longitudinal features, such as illustrated in FIGS. 1 and 2, that can be extruded. For instance, the cross section of the base is consistent throughout the length so that the rear support is the same height throughout the length of the base, and the front support is the same height throughout the length of the base.

A drill or cut operation may be included to provide one or more drain slots in the support member front support so that water may drain from the sill pan flashing.

End segments which are molded or otherwise produced may be attached to a desired length of base in order to provide a completed sill pan flashing unit.

DETAILED DESCRIPTION OF EMBODIMENT

Metal Sill Pan Flashing

A metal sill pan flashing or a plastic sill pan flashing may be manufactured by extrusion as described above.

Figure 6:
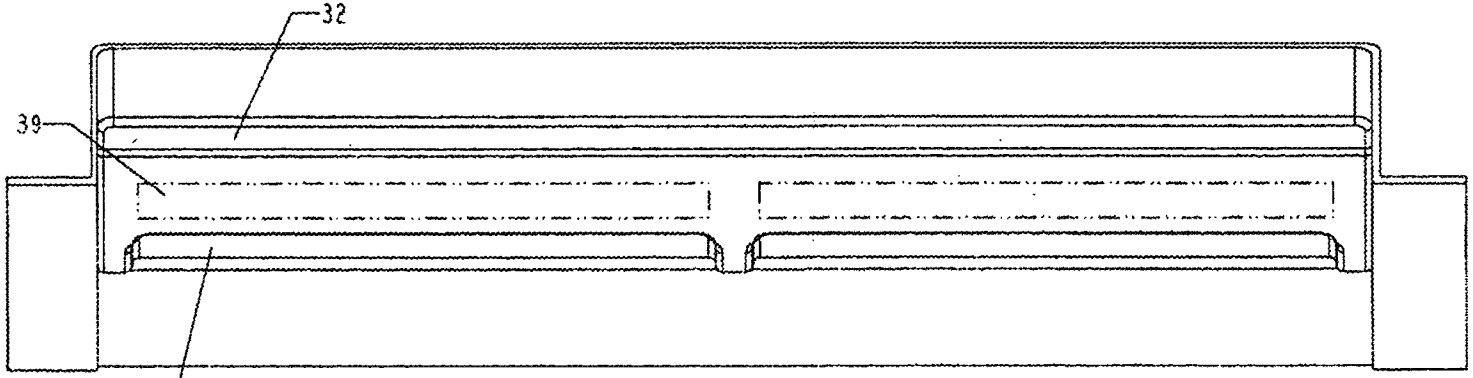
FIG. 6 is a metal embodiment of the invention with a lateral additional central ridge.

Referring now to FIG. 6, which is another metal embodiment of the invention, the sill pan flashing may include a center support ridge 39 which includes drain-hole areas. In this example the sill pan flashing is fabricated from a metal such as stainless steel. Other metals such as copper, lead, or aluminum may also be used.

The metal sill pan flashing may also be produced by welding or otherwise securing the metal members.

DETAILED DESCRIPTION OF EMBODIMENT

Sill Pan Flashing with Extruded Base Sections Joined by Connectors to Form a Desired Length In this embodiment the middle base may be constructed from two or more relatively short pieces which are joined by connector segments on one or both ends to achieve a desired length. In one connector embodiment, each end of the connector includes tabs such as 46 and 47 shown in FIGS. 4 and 5. These tabs fit into channels 44 and 45 on the base unit segments. The sill pan flashing also comprises end pieces which may be snapped onto or glued to the ends of the base unit.

DETAILED DESCRIPTION OF EMBODIMENT

Fiberglass

In this embodiment, the door or window is supported by a rear support element and a front support element of a fiberglass sill pan flashing.

Figure 7A:
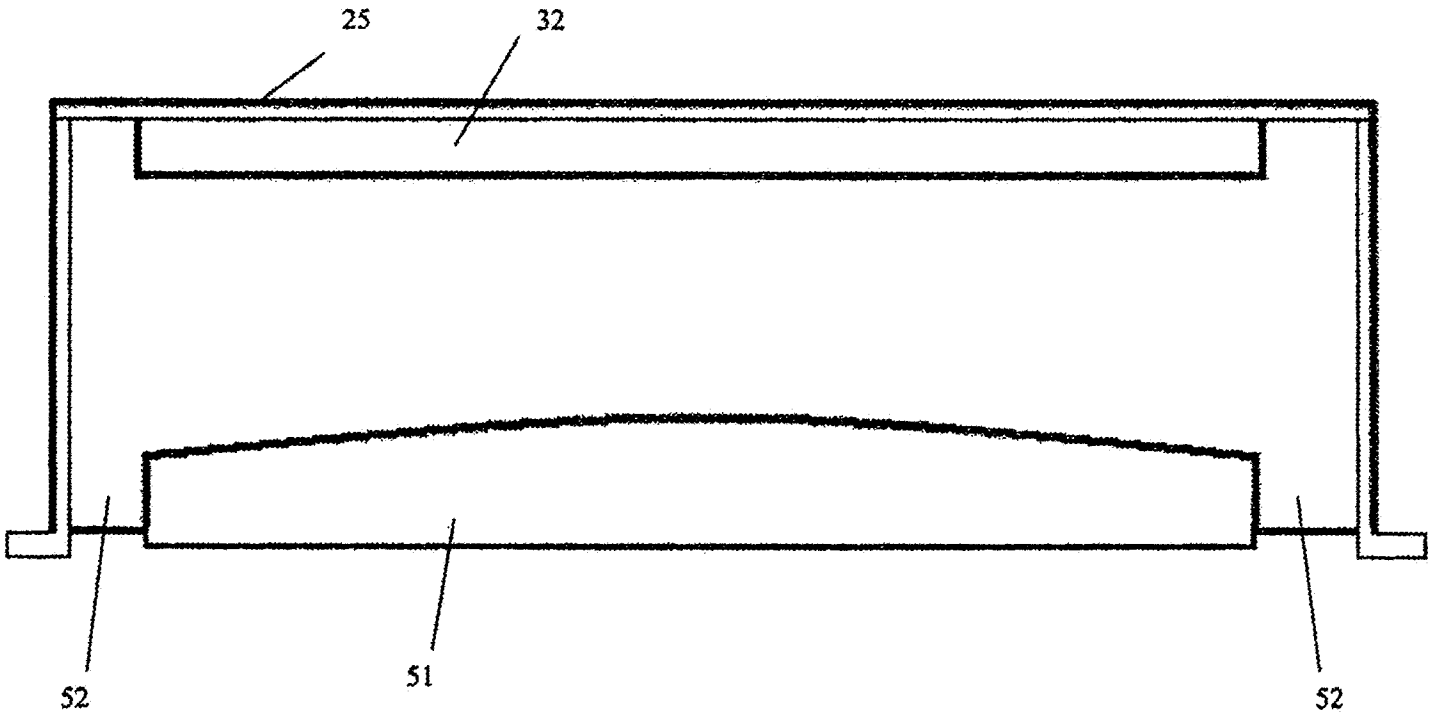
FIG. 7A is a top view of a fiberglass embodiment of the invention.

FIG. 7A is a top view of a fiberglass sill pan flashing which includes a rear support 32 and a front support 51 which tapers in plan toward drainage openings 52. This taper directs water to the drainage openings. The drainage openings such as gaps, holes, or slots are typically provided at the ends of the front support, and may also be provided at one or more locations along the length of the support. Alternatively, weep holes may be provided in the front support. The weep holes may be formed as part of a molding operation in fiberglass or as a post extrusion process step for metal or plastic sill pan flashing.

Figure 7B:
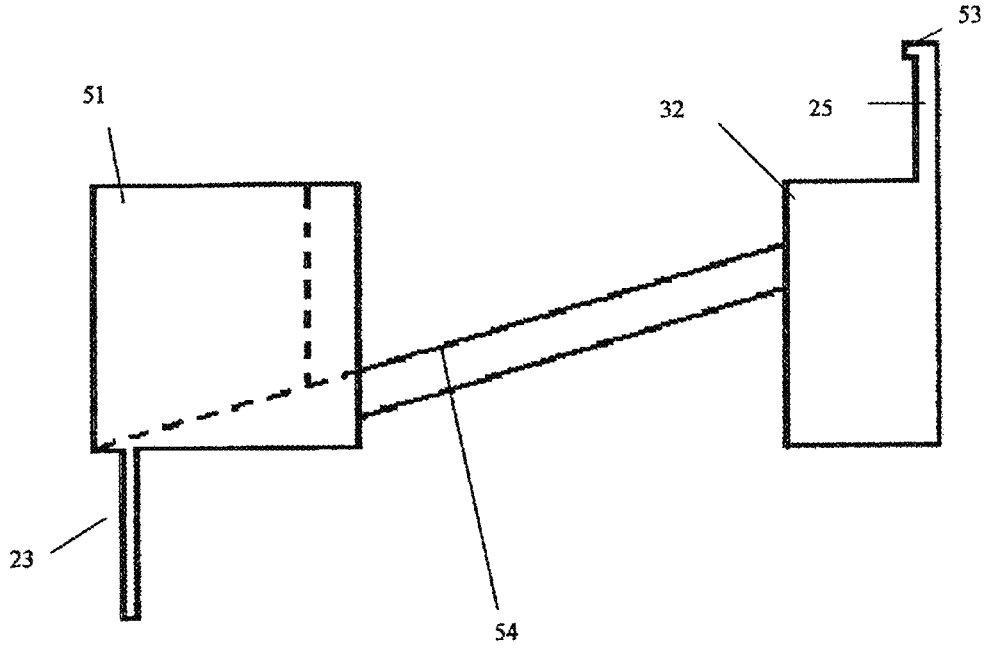
FIG. 7B is a cross section view of the fiberglass embodiment of FIG. 7A.
Figure 7C:
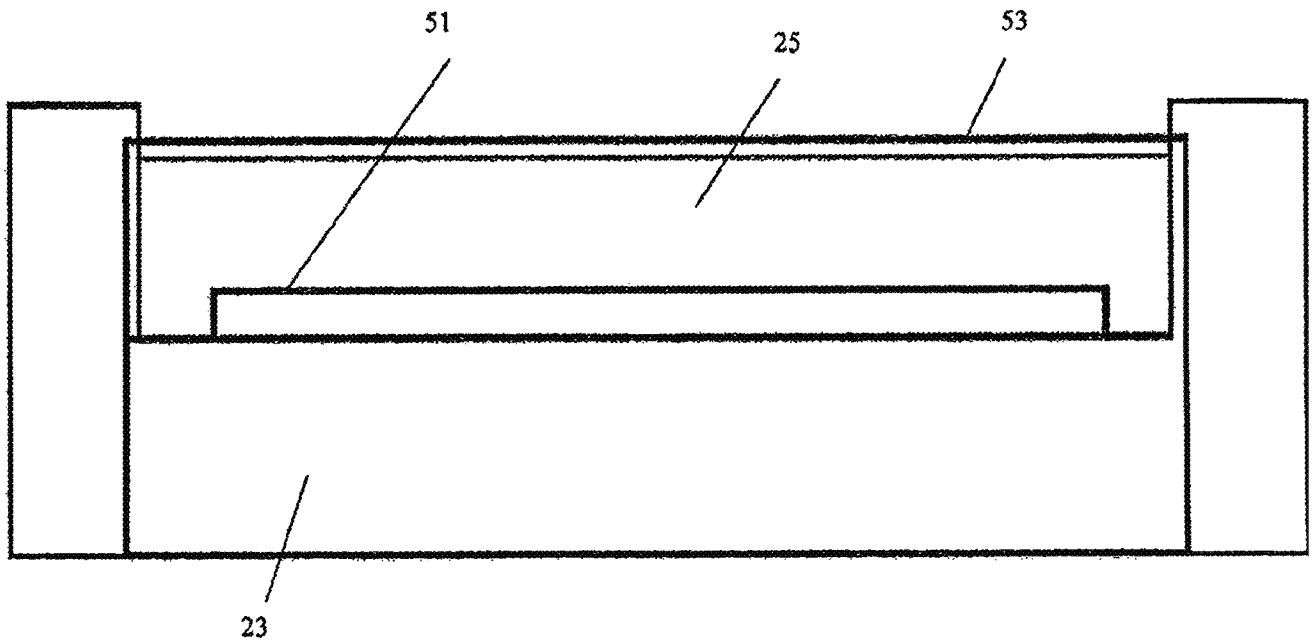
FIG. 7C is a front view of a fiberglass embodiment of FIG. 7A.

FIG. 7B is a cross section view of the fiberglass sill pan flashing of FIG. 7A, and FIG. 7C is a front view of the sill pan flashing. The rear wall may include a lip 53, The front edge of the rear support 32 may be tapered for ease of manufacture. In this embodiment, the sill pan flashing includes a sloping drain surface 54. In this example, the fiberglass base does not have a solid surface on the bottom, and the front and rear support ridges extend to the bottom of the sill pan flashing, and no additional supports are required for the sloping drain surface 54. If the sloping drain surface were load-bearing, then additional supports may be provided.

DETAILED DESCRIPTION OF EMBODIMENT

Alternate Fiberglass Sill Pan Flashing

Figure 12B:
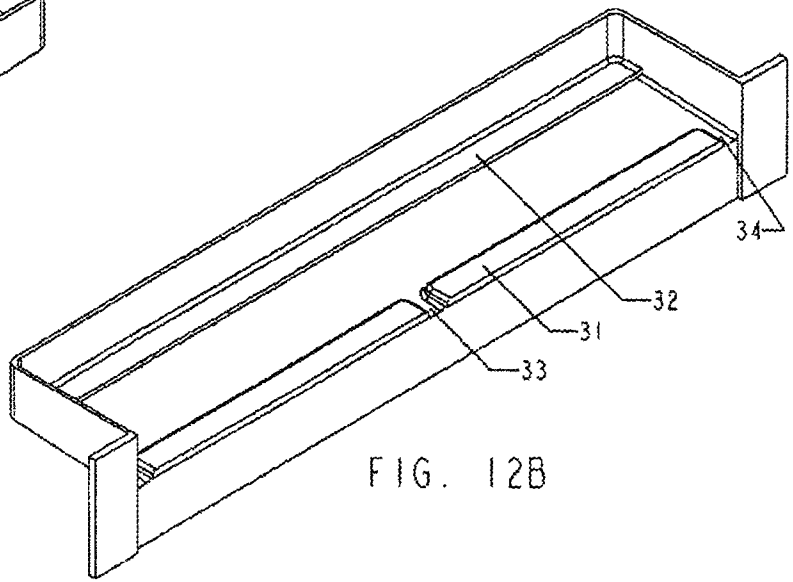
FIG. 12B is a perspective view of a fiberglass sill pan flashing embodiment.
Figure 12A:
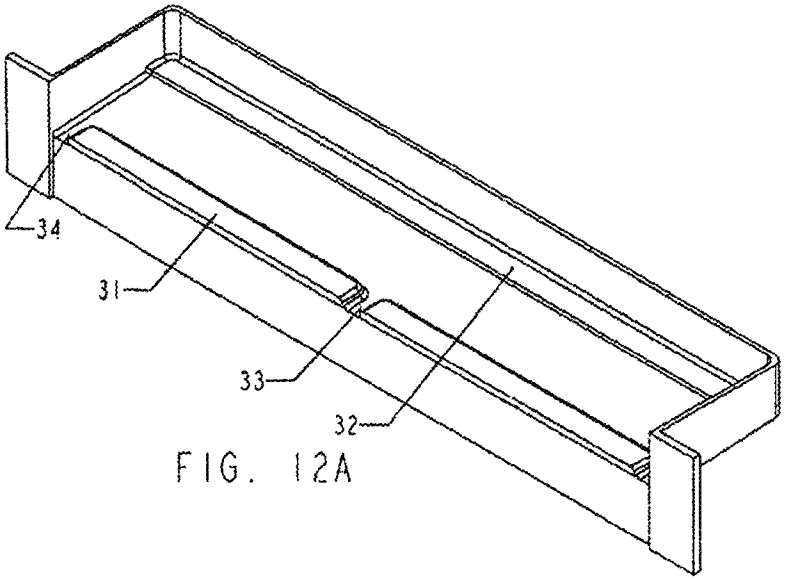
FIG. 12A is a perspective view of a fiberglass sill pan flashing embodiment.

FIGS. 12A and 12B are front perspective views of an alternate fiberglass sill pan flashing. In this embodiment, the window or door is supported by a rear support 32 and a front support 31. In this embodiment, the front support is not tapered as in the previous example. Drain slots 33 and 34 are provided in the front support in order to remove water from the sill pan flashing.

DETAILED DESCRIPTION OF EMBODIMENT

Extruded Base with Alternate Interlocking End Pieces

Figure 8:
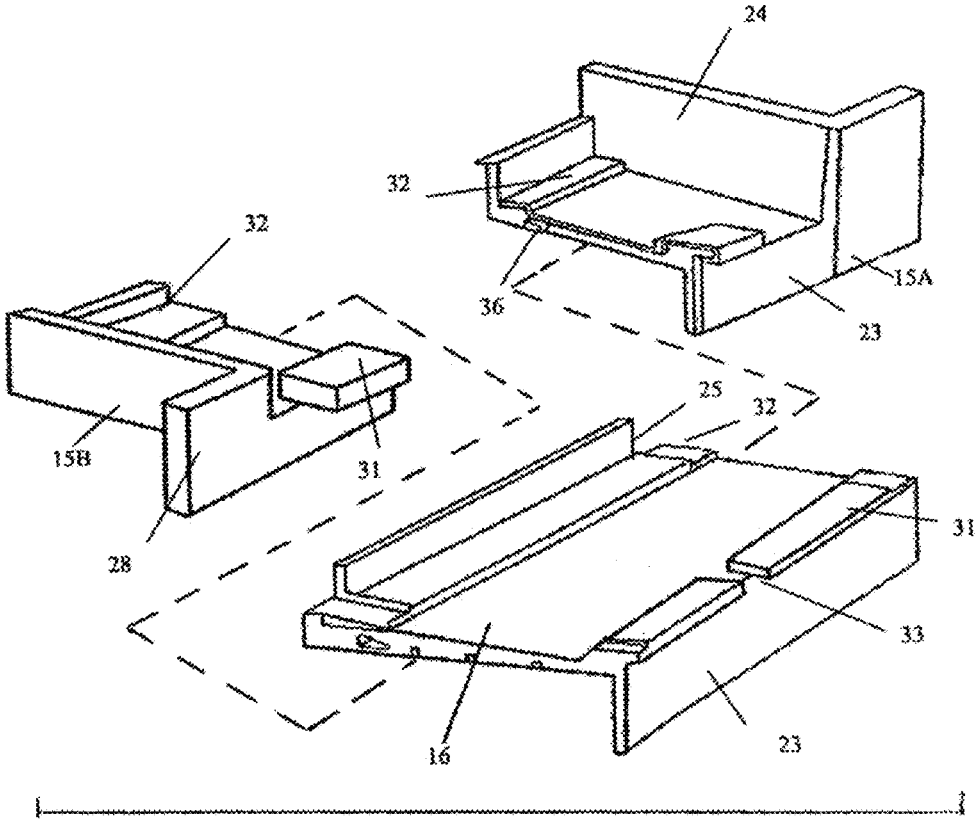
FIG. 8 is an exploded view of an alternate embodiment with a base element and end elements.

FIG. 8 is an exploded view of an alternate embodiment with a base element 16 and corner end elements 15A and 15B. In this embodiment, the end pieces are designed to fit over cut down portions to the front support 31 and rear support 32 and rear wall 25 so that the front and rear supports are essentially constant height across the assembled sill pan flashing. In this embodiment, the base element 16 is typically produced by extrusion, and right and left end pieces 15A and 15B are typically molded, such as by injection molding.

Figure 9:
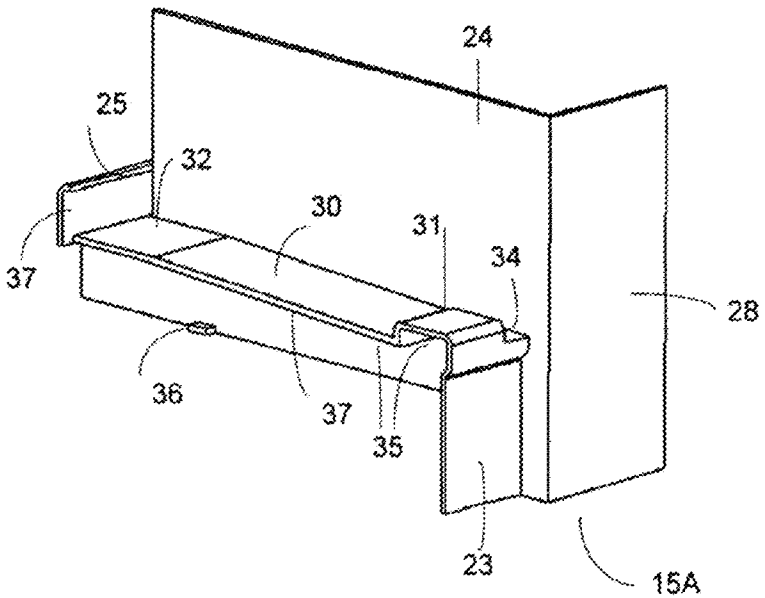
FIG. 9 is an enlarged detail view of a right end element for the embodiment of FIG. 8.

Referring now to FIG. 9 which is an enlarged detail view of a right end element 15A for the embodiment of FIG. 8, the end element includes a an overlapping lip 35 which fits over a portion of the right end of the base. The overlapping lip includes a rear portion which fits over a portion of the rear wall of the right end of the base, a rear support portion which fits over a portion of the rear support of the right end of the base, a middle portion which fits over a portion of the right end of the base between the rear support and the front support, a front support portion which fits over a portion of the front support of the right end of the base, and a front lip portion which fits over a portion of the front lip of the right end of the base. Preferably, the overlapping lip overlaps the right end of the base in a manner that keeps the rear support and the front support substantially level across the sill pan flashing. This end piece, also described as a lock-in corner, is preferably molded such as by injection molding, or vacuum forming.

Figure 10:
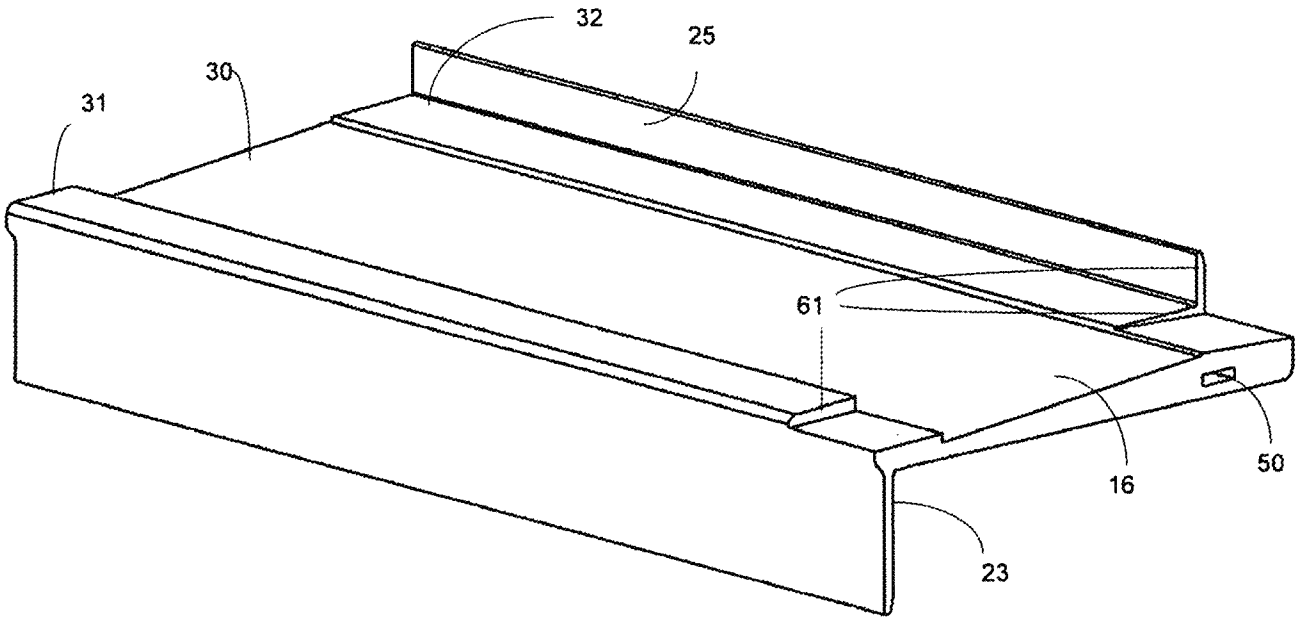
FIG. 10 is a perspective view of a lock in channel base plate for the embodiment of FIG. 8.

Referring now to FIG. 10 which is a perspective view of a lock-in channel base plate 16 for the embodiment of FIG. 8, the right end of the base plate or lock in channel plate is preferably provided with incisions 61 on the front support plate 31, on the rear ridge 32, and on the rear upward lip 25. In one embodiment, these incisions are prepared after cutting a standard length of extruded sill pan flashing base, such as a 16 foot length, to a desired length. The incisions remove a portion of the right end of the front support plate 31, the rear ridge 32, and the rear upward lip 25 as shown in FIG. 10. This removal may be accomplished by cutting a plastic or metal piece to the desired depth with a hacksaw or other cutting tool. In some cases, the cut material may be removed by a chisel. In other cases a special cutting tool may be provided.

Figure 11:
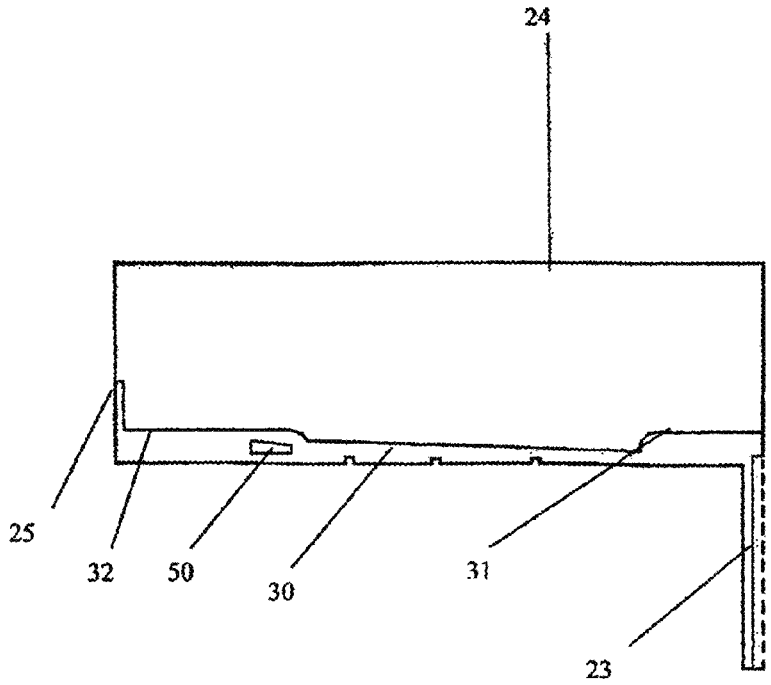
FIG. 11 is a cross sectional view of the base element for the embodiment of FIG. 8.

Referring now to FIG. 11 which is a cross sectional view of the base element for the embodiment of FIG. 8, the base plate includes a keyed channel 50 for receiving a keyed profile 36 from the corner element. In some embodiments, the rear upward lip 25 may be extended downward or back and downward, to provide a surface that can be nailed or screwed into the window or door framing elements. The base preferably includes a plurality of channels that can be used to accept an excess of a sealant or adhesive that may be used to set the window or door sill. Although it is desirable to provide a level window or door opening, in practice it is often difficult to achieve a level framing. In such cases, the sill pan flashing may be set on an adhesive, such as PL 400 or PL Premium, by Osi Sealants, Inc.; or on a sealant such as NP1 by Sonneborn, by Chemrex.

In one embodiment, a window may be set into the sill pan flashing and attached to the front ridge, by an adhesive. Drainage holes or slots in the front ridge are open, or will open, to direct the moisture to the outside.

DETAILED DESCRIPTION OF EMBODIMENT

Extruded Plastic Base with UV Resistance

In this embodiment, the base is extruded from a plastic such as PVC, polyvinyl chloride. The plastic includes ultraviolet light (UV) inhibitors that prevent the UV light from breaking down the plastic.

DETAILED DESCRIPTION OF EMBODIMENT

Extrusion and Cutting Process

It is desirable to develop an extrusion process for plastic or metal sill pan flashings. In some embodiments, door or window supports may be provided in a lateral orientation to permit the supports to be extruded. In an alternate embodiment, the base unit may be extruded as a solid piece and then post-processed with a cutting operation to remove material.

Figure 13A:
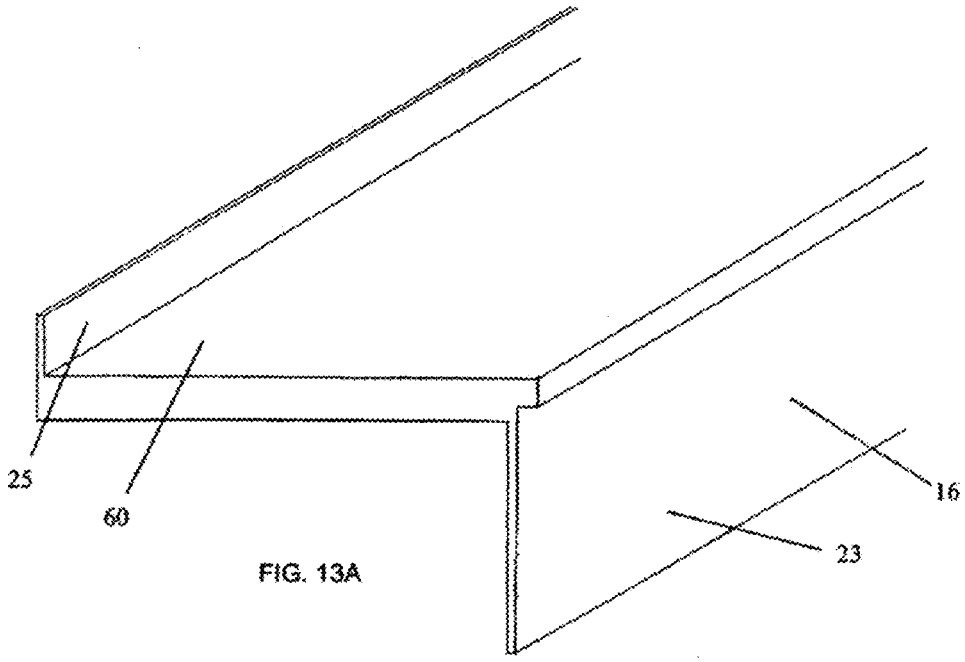
FIG. 13A is a top perspective view of an extruded sill pan flashing section.
Figure 13B:
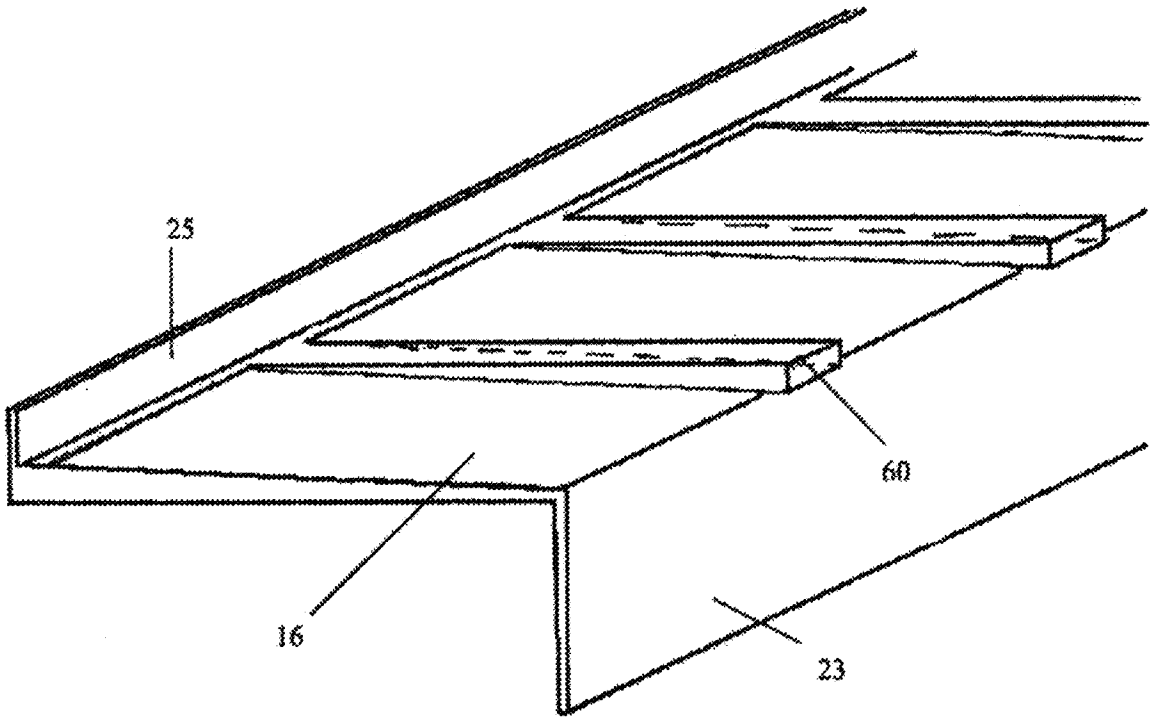
FIG. 13B is a perspective view of the extruded sill pan flashing section of FIG. 13A with material removed in order to create a drain path.

For example, the base plate can be extruded with no slope on the top surface 60 as illustrated in FIG. 13A, so that the top surface is parallel with the bottom surface. After extrusion, the base plate can be inserted in a tool, such as punch press, saw, or combination, or device to make incisions in the top surface. In one embodiment, incisions 62, as shown in FIG. 13B, have a downward slope towards the front of the sill pan flashing, and may be perpendicular to the sill pan flashing or at an angle with respect to the sill pan flashing. For example, incisions can be 3" wide, and ½" apart. Incisions create drainage channels, and spaces between incisions create offsets to permit a drain path. Offsets typically have a coplanar surface and are used as support for installation of windows and doors.

Figure 14A:
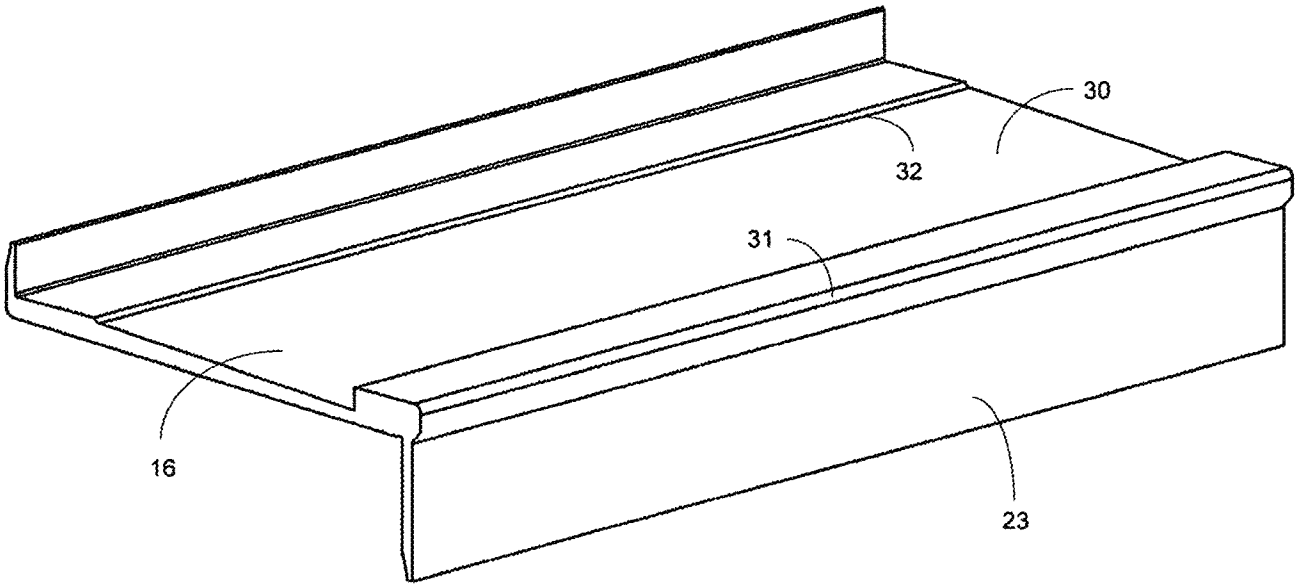
FIG. 14A is a top perspective views of another embodiment of an extruded sill pan flashing section.
Figure 14B:
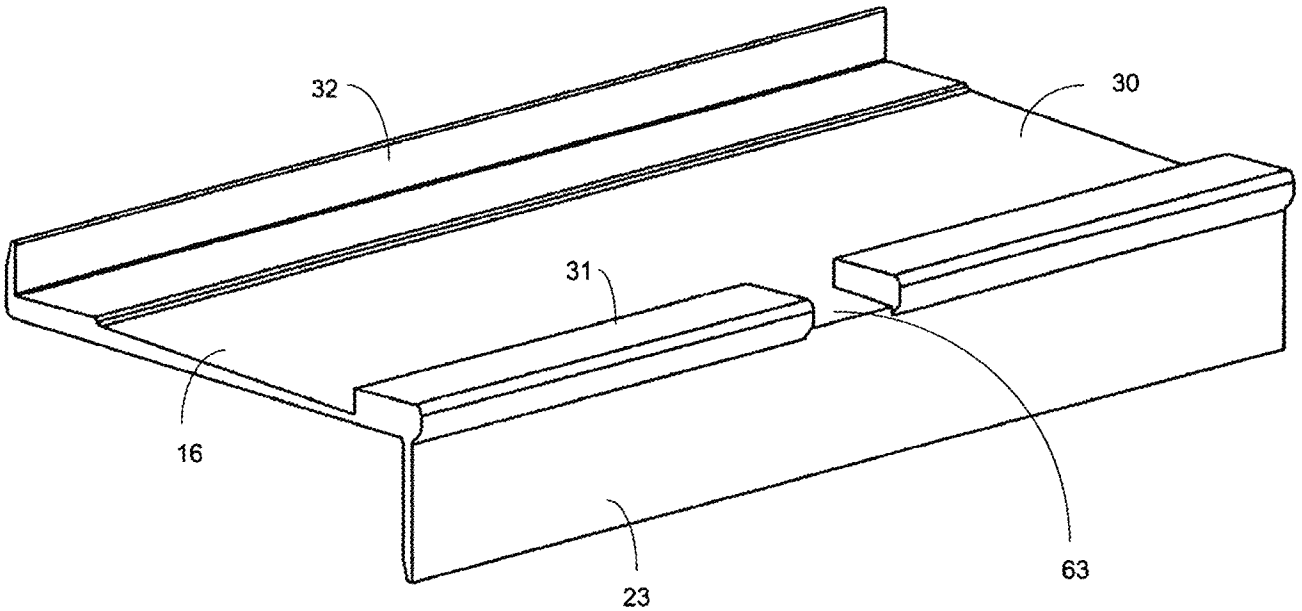
FIG. 14B is a top perspective view of the extruded sill pan flashing section of FIG. 14A with a drain slot.

In another post-extrusion processing example, an extrusion creates the middle piece or lock-in channel plate 16 as described in embodiments above. The top surface of the sill pan flashing 30 is sloped toward the front of the sill pan flashing. The extruded section has a front support ridge 31 and a rear support ridge 32 which are typically coplanar. One or more intermediate ridges may be provided between the front ad rear support ridge. After extrusion, this middle section 16 can be inserted in a tool, such as punch press or saw, or other device that makes cuts in the front and intermediate ridges in order for water to drain downwardly and outwardly through the ridges. The bottom of the incisions 63 as shown in FIG. 14B would have coplanar surface with the sloping top surface 30 of the lock-in channel plate. For example, incisions can be ½" wide, 12" apart. This embodiment shows example with perpendicular incisions on the front ridge, and other incision orientations are possible. In another embodiment, the auxiliary ridges may drain to the ends of the ridge, without additional drain slots in the middle of the ridges. This embodiment shows example with perpendicular incisions on the front ridge, and other incision orientations are possible.

DETAILED DESCRIPTION OF EMBODIMENT

Extruded Base with Alternated Interlocking End Pieces

Figures 15A, 15B:
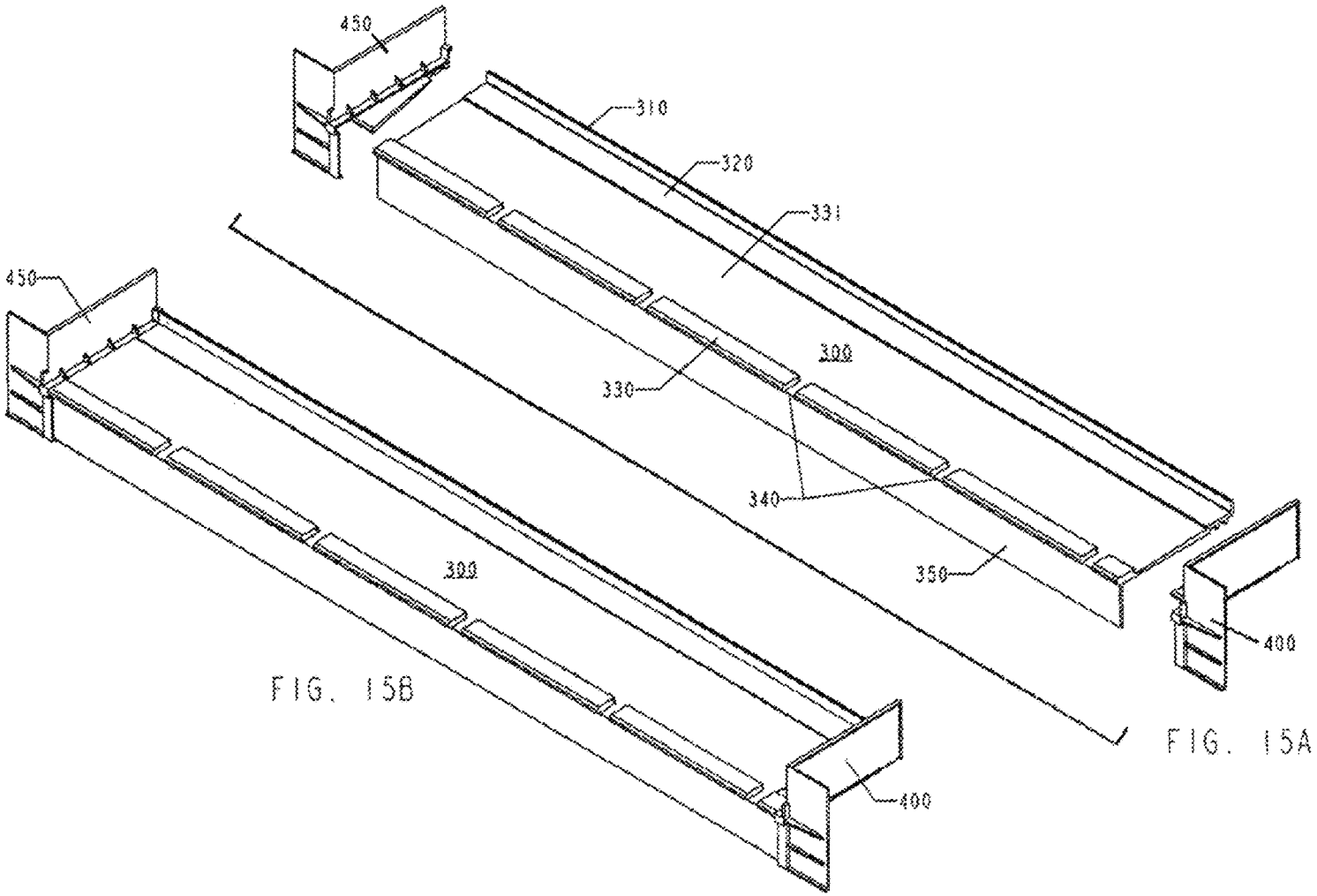
FIG. 15A is an exploded top perspective view of a sill pan flashing base and corner units.
FIG. 15B is a top perspective view of the assembled base and corner units of the sill pan flashing of the embodiment of FIG. 15A.
Figure 15C:
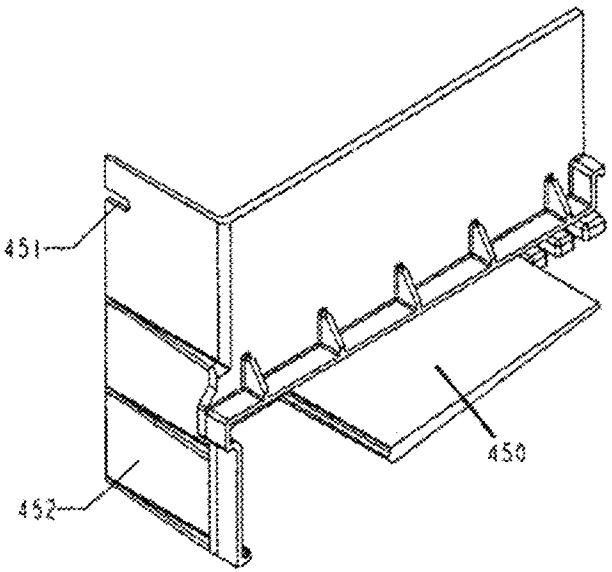
FIG. 15C is a top perspective view of an alternate embodiment of a right end element.

FIG. 15A is an exploded top perspective view of a base 300 which may be extruded and corner units 400 and 450 which are typically molded. The base includes a rear wall 310, a rear support 320, a base top surface 331 which may be sloped, a front support 330 with drain gaps 340, and a front face 350. In this embodiment, the drain gaps are preferably provided on 6" centers. FIG. 15B is a top perspective view of the assembled base 300 and corner units 400 and 450 of FIG. 15A. FIG. 15C is a top perspective view of an alternate embodiment of a right end element 450 which includes a nail slot 451 in the side flange 452. In this embodiment, the nail slot has a height of about 0.13 inches.

Figure 16:
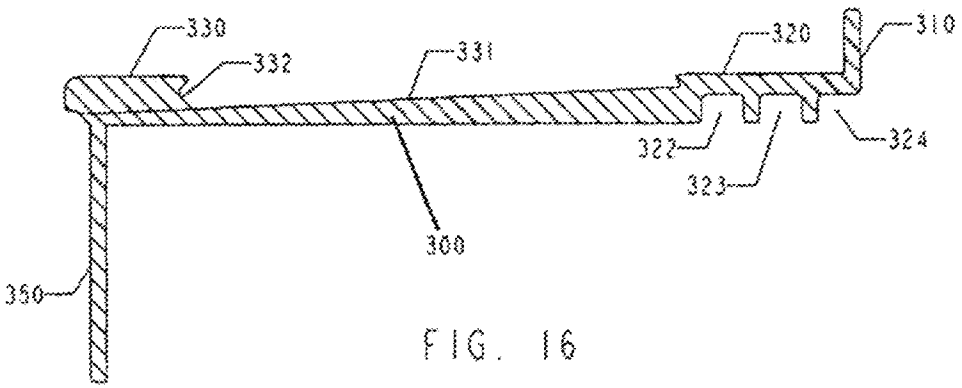
FIG. 16 is a detailed cross section view of the base of the embodiment of FIG. 15A.

FIG. 16 is a detailed cross section view of the base 300 of FIG. 15A. In this example, the front support 330 overlaps the front face 350, and includes an inset rear face 332. The rear support 320 includes recesses 322, 323, and 324 for engaging tabs from a corner element. In one example, the base has a depth of about 4.688", a front support width of about 0.722", a rear support width of about 0.989", and rear wall and front face thicknesses of about 0.94". In this embodiment the base top surface has a slope of about 1.7 degrees.

Figure 17B:
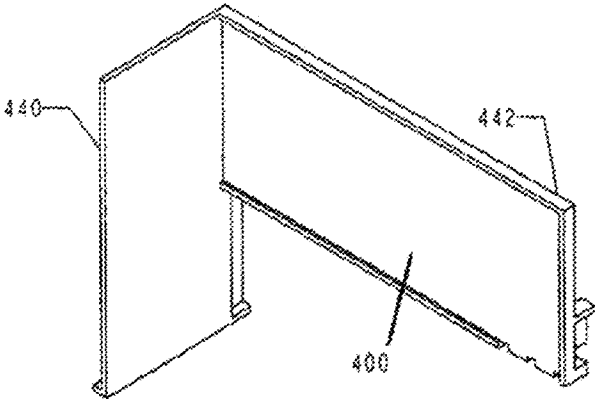
FIG. 17B is a rear perspective view of the right corner unit of the embodiment of FIG. 15A.
Figure 17C:
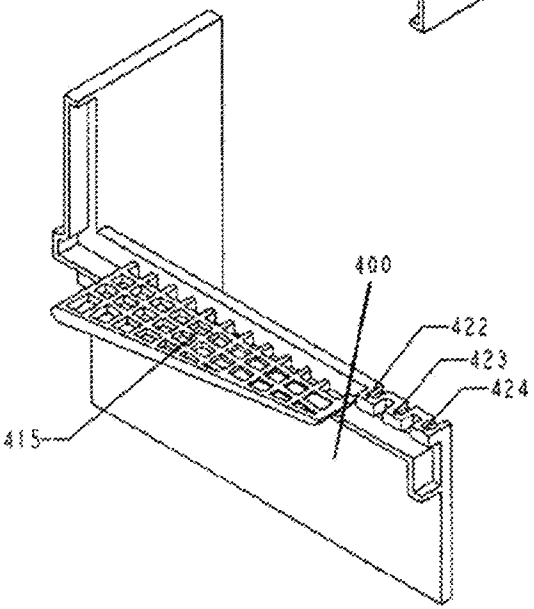
FIG. 17C is a bottom perspective view of the right corner unit of the embodiment of FIG. 15A.
Figure 17A:
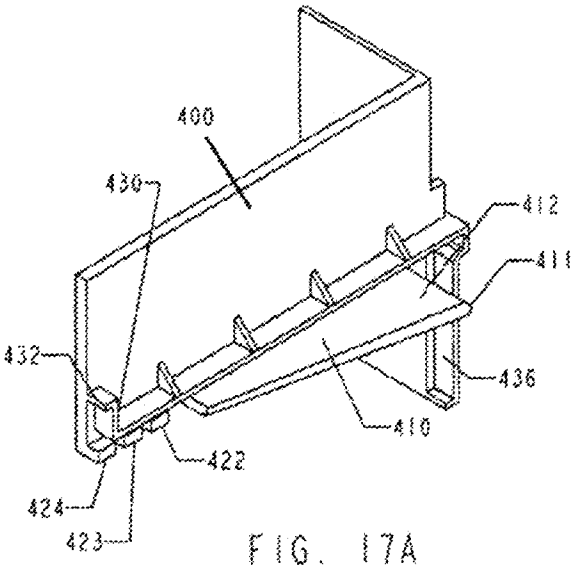
FIG. 17A is a front perspective view of the right corner unit of the embodiment of FIG. 15A.

FIGS. 17A and 17B are front and rear perspective views of a right corner unit 400 which includes a front face 440 and a side face 442. In this example, the corner unit has several overlap features to snap or press fit with a base unit so that the sill pan flashing can be assembled without glue or adhesive if desired. An overlap tab 410 is provided with a width selected to form a press fit between the front edge of the rear support 320 and the inset rear face 332 of the front support 330. In this example, the tab has a convex front face 411 to fit with the inset rear face 332 of the front support. The width of tab 410 is preferably slightly tapered on the end so that the fit becomes tighter as the corner is inserted on the base 300. This tab has a top surface 412 that aligns with the top surfaces of the rear and front supports. In this example, the corner unit also includes a rear wall 430 and a lip 432 which overlap the base rear wall 310, and a front inset portion 436 which overlaps the front face 350 and front end of the front support 330.

FIG. 17C is a bottom perspective view of the right corner unit 400 which shows rear tabs 422, 423, and 424 which mate in the base section recesses 322, 323, and 324 respectively. These tabs are also preferably slightly tapered on the ends.

In this example, the left corner unit 450 is symmetrical to the right corner unit and includes similar tabs and overlap features.

This embodiment permits a sill pan flashing base section to be cut to a desired length in the field for fitting a particular opening. The corner piece elements are then installed on the base section, and the assembled sill pan flashing is placed on the bottom of the rough opening, so that the assembled sill pan flashing provides directional drainage for the entire rough opening. The window or door is then installed on top of the sill pan flashing and inside the rough opening.

DETAILED DESCRIPTION OF EMBODIMENT

Adjustable Sliding Joint

In this embodiment, the sill pan flashing comprises a first section which includes a first corner and a portion of the base, and a second section which includes a second corner and a portion of the base. These sections are designed to slide together without adhesive in a manner that provides for a framing tolerance of several inches. For wider openings a third center section is provided.

Each portion of base includes a lower part offset from an upper part. In one section, the upper part extends past the lower part, and in the other section the lower part extends past the upper part. These extensions provide an installation tolerance. For instance, a typical 3' door requires a framed rough opening of 36½" to 39". It is desirable to provide a sill pan flashing which will fit into the opening and cover the entire rough opening width regardless of the actual dimension of the rough framing.

Figures 18A, 18B, 18C:
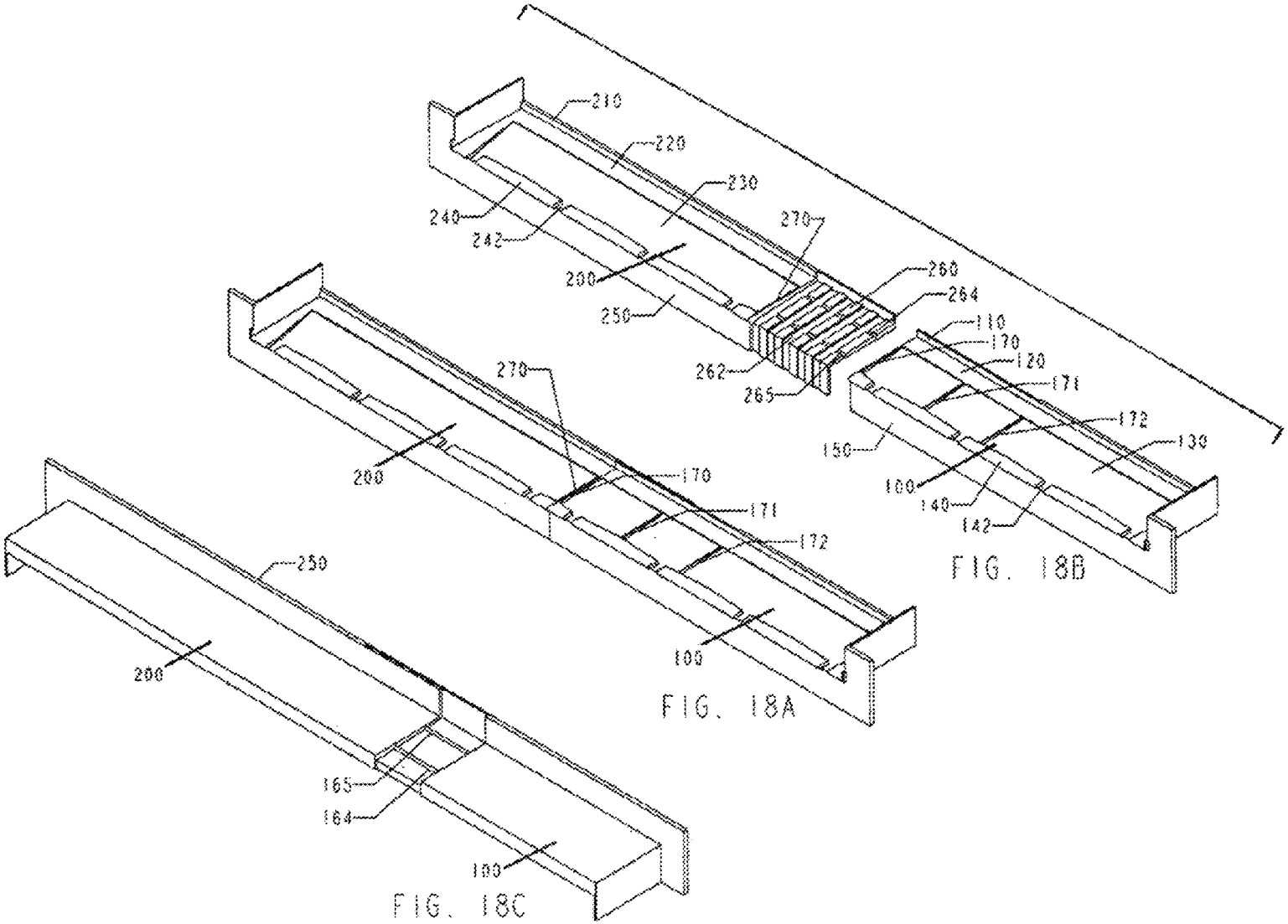
FIG. 18A is a top perspective view of an assembled two-part sliding joint sill pan flashing.
FIG. 18B is an exploded top perspective view of the two-part sliding joint sill pan flashing of FIG. 18A.
FIG. 18C is a bottom perspective view of the two-part sliding joint sill pan flashing of FIG. 18A.

FIG. 18A is a top perspective view of an assembled two-part sliding joint sill pan flashing having a first section 100 which overlaps a portion of a second section 200. In this example, the first section 100 includes a rear wall 110, a rear support 120, a sloped base top surface 130, a front support 140 with drain gaps 142, and a front face 150. The first section also includes dams 170, 171, and 172. The second section 200 includes a rear wall 210, a rear support 220, a front face 250, and an end dam 270. In this example, the first section includes a right corner, and the second section includes a left corner. The second section end dam 270 is snapped or glued between the rear support and the front support of the second section so that it retains accumulated water over the sloped base top surface 230 and directs that water to drain forward rather than toward the first section 100.

FIG. 18B is an exploded top perspective view of the two-part sliding joint sill pan flashing of FIG. 18A. In this embodiment, the second section 200 includes an end portion with ribs 260 which support the overlapping end of the first section. The support ridges 260 preferably have a downward slope toward the front of the sill pan flashing. The support ridges 260 define base drain channels 262 for draining any moisture toward the front of the sill pan flashing. The base channels 262 are preferably also sloped toward the front of the sill pan flashing. The front end of the support ridges 260 overlap the front face 250 so that there is a drainage area provided between the front faces of the top part an bottom part. The end portion also includes channels 264 and 265 for aligning with ribs 164 and 165 of the first section as shown in FIG. 18C which is a bottom perspective view of the assembled sill pan flashing. The ribbed end portion of the second section extends 3" beyond the end dam 270.

Figure 18E:
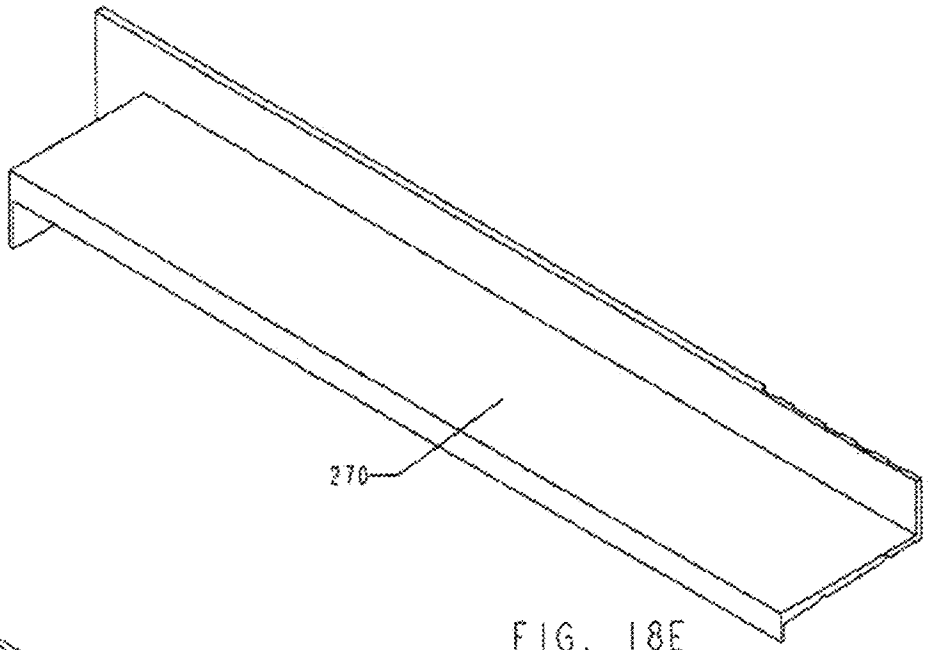
FIG. 18E is a bottom perspective view of the second section of the two-part sliding joint sill pan flashing of FIG. 18A
Figure 18D:
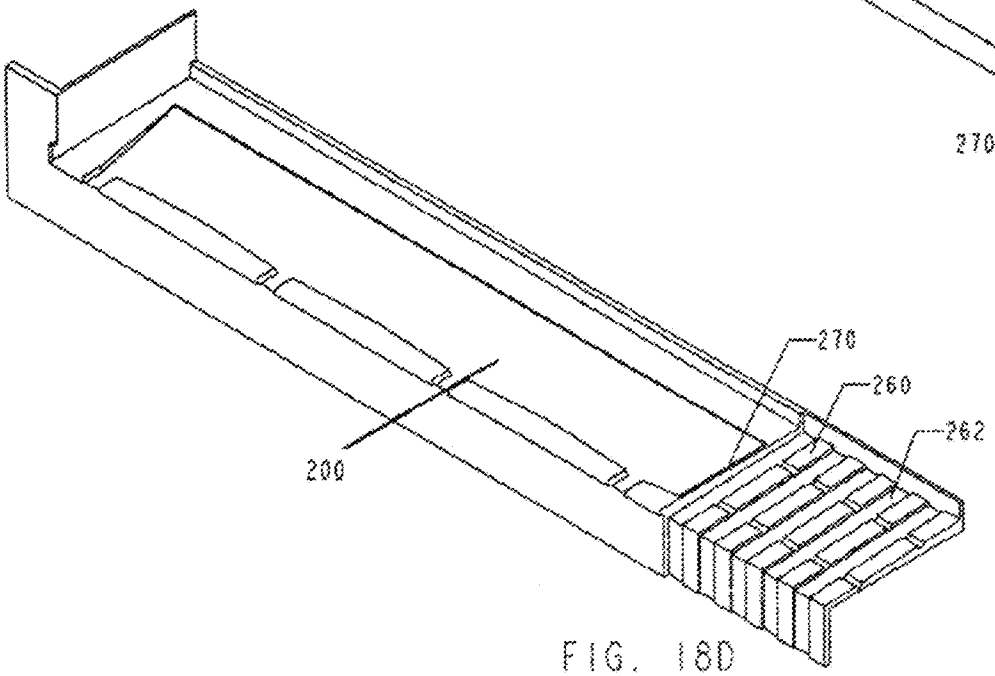
FIG. 18D is a top perspective view of the second section of the two-part sliding joint sill pan flashing of FIG. 18A

FIG. 18D is a top perspective view of the second section 200 showing details of the end dam 270, the ribs 260, drain channels 262, and alignment channels 264 and 265.

FIG. 18E is a bottom perspective view of the second section 200 showing a flat bottom surface 270.

Figure 18G:
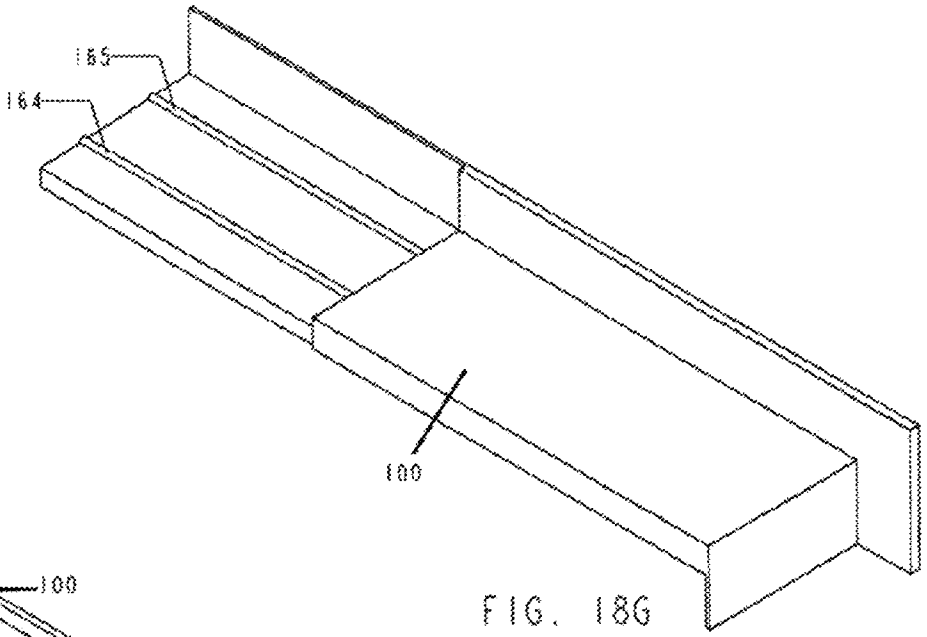
FIG. 18G is a bottom perspective view of the first section of the two-part sliding joint sill pan flashing of FIG. 18A
Figure 18F:
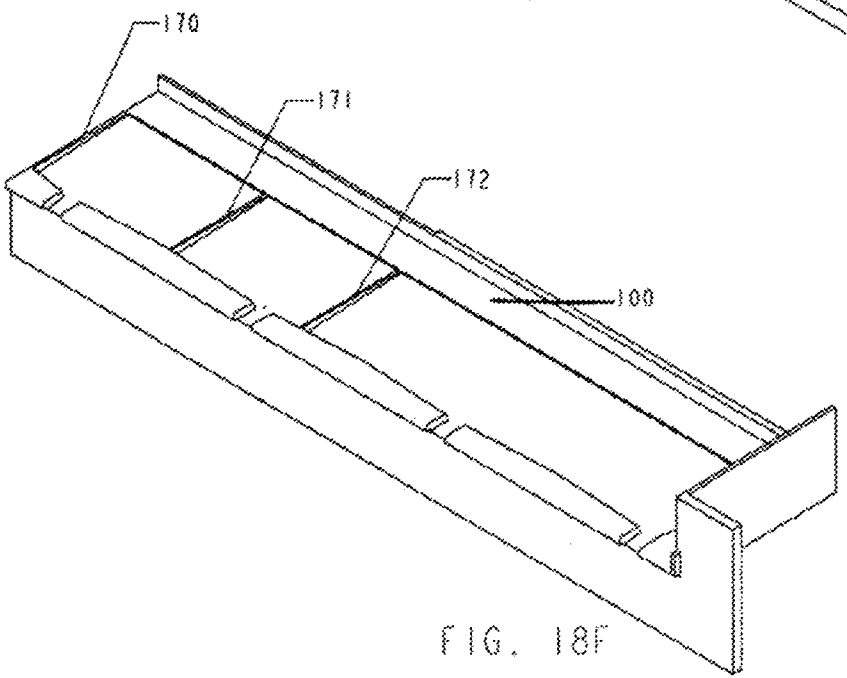
FIG. 18F is a top perspective view of the first section of the two-part sliding joint sill pan flashing of FIG. 18A

FIG. 18F is a top perspective view of the first section 100 showing details of dams 170, 171, and 172 which are preferably molded with the section.

FIG. 18G is a bottom perspective view of the first section 100 showing details of aligning ribs 164 and 165.

Figures 19A, 19B, 19C:
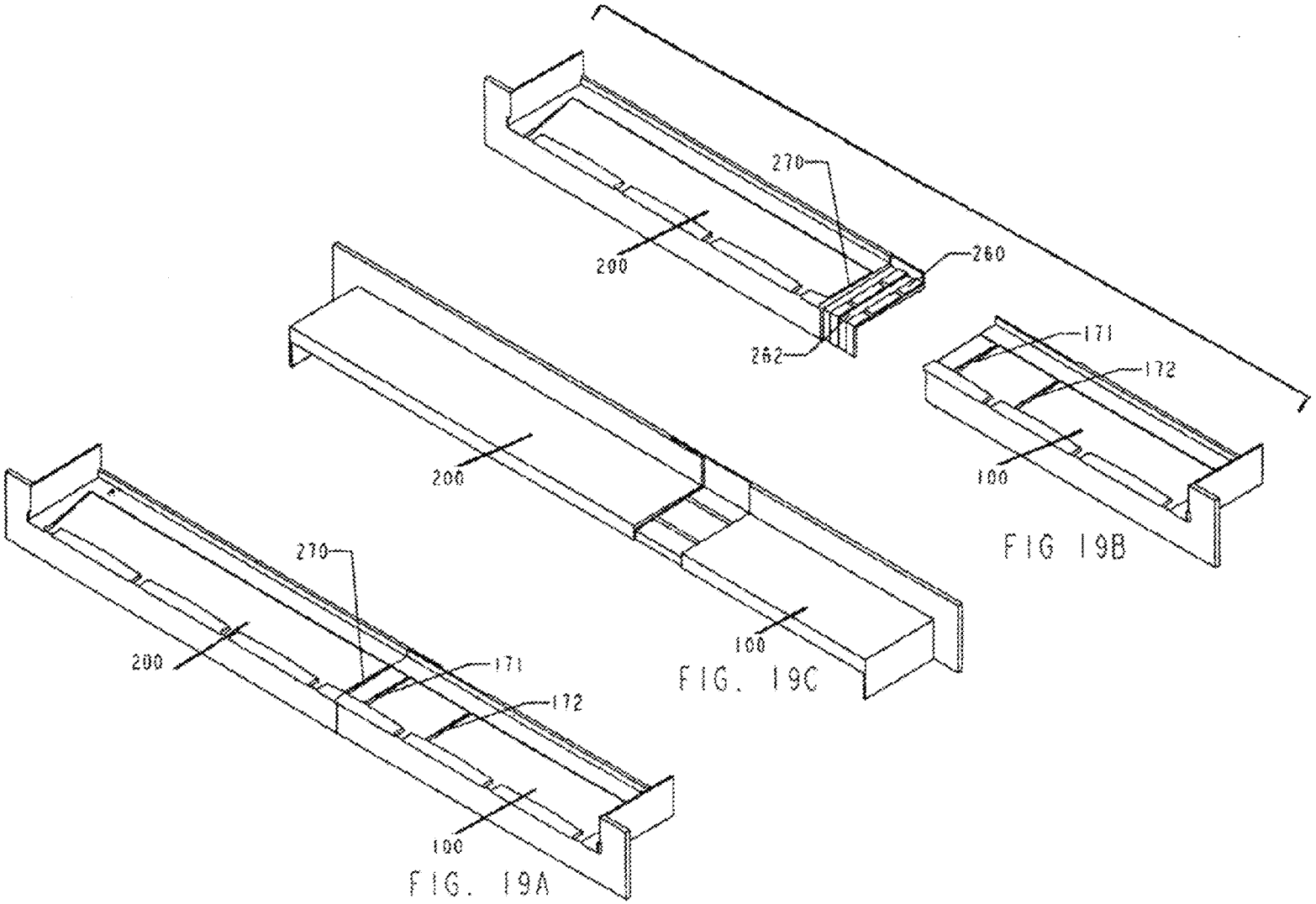
FIG. 19A is a top perspective view of an assembled two-part sliding joint sill pan flashing where the sections have been cut to a desired length.
FIG. 19B is an exploded top perspective view of the two-part sliding joint sill pan flashing of FIG. 19A.
FIG. 19C is a bottom perspective view of the two-part sliding joint sill pan flashing of FIG. 19A.

FIG. 19A is a top perspective view of an assembled two-part sliding joint sill pan flashing where the sections 100 and 200 have been cut to a desired length.

FIG. 19B is an exploded top perspective view of the two-part sliding joint sill pan flashing of FIG. 19A which shows the first section 100 cut at a point past the dam 171 and the dam 170 (not shown). In this example, the end portion of the second section 200 has also been shortened. The shortened first section and the shortened second section are assembled as shown FIG. 19C which is a bottom perspective view of the assembled sill pan flashing. In some cases it may not be necessary to cut either side, because the sliding joint feature will accommodate a range of lengths. In other cases, it is only necessary to cut one of the sections in order to create a sill pan flashing with the desired length.

In this example, the top part extends 5" beyond the top part. A typical minimum overlap between the first section and the second section is about 1½, so that the working range of this embodiment has a range of about 6½" in width. This working range may be utilized by increasing the overlap of the sections.

The top surfaces 130 and 230 of the first section and the second section may be continuously sloping. In other embodiments, the profile of the top surfaces of the sill pan flashing may be flat in the rear and front and sloping in the middle. This variable profile may enhance the interlocking between the top part and the bottom part.

The top part and bottom part sections are typically fabricated separately, and the first section is inserted over the second section. The assembly may be glued in the factory, but is designed to be snapped together without adhesive in the field.

This embodiment may be fabricated from a plastic such as PVC or a metal such as aluminum. Parts can be made by injection molding, or blow-molding plastic/PVC, or aluminum casting, or with other materials and manufacturing methods.

This embodiment provides sliding joints to accommodate variations within a range of window or door size, and in rough opening size without cutting the sill pan flashing. Alternately, the sill pan flashing can be shortened in the field by cutting a portion from the mating end of each section.

Figure 20B:
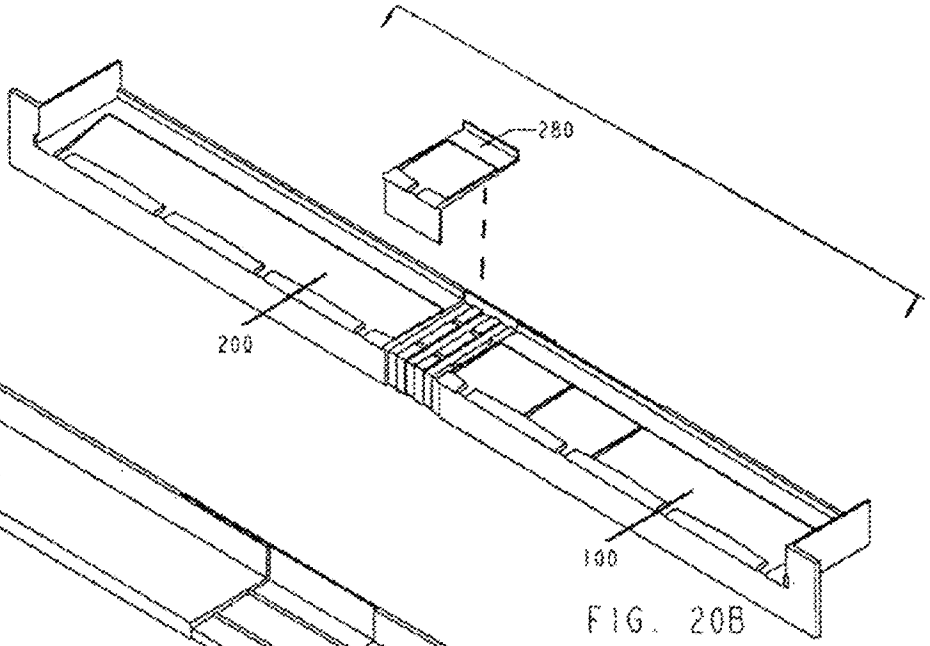
FIG. 20B is an exploded top perspective view of the two-part sliding joint sill pan flashing of FIG. 20A
Figure 20C:
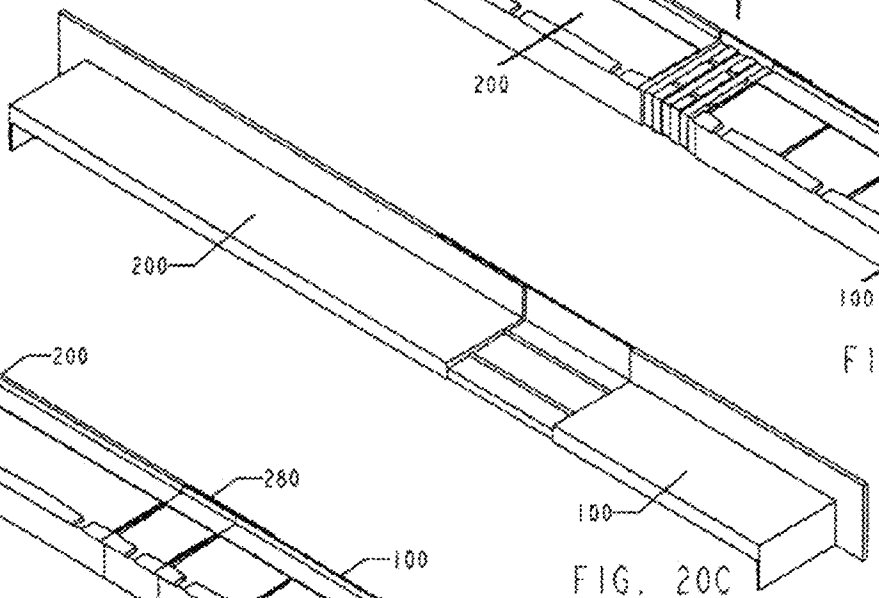
FIG. 20C is a bottom perspective view of the two-part sliding joint sill pan flashing of FIG. 20A
Figure 20A:
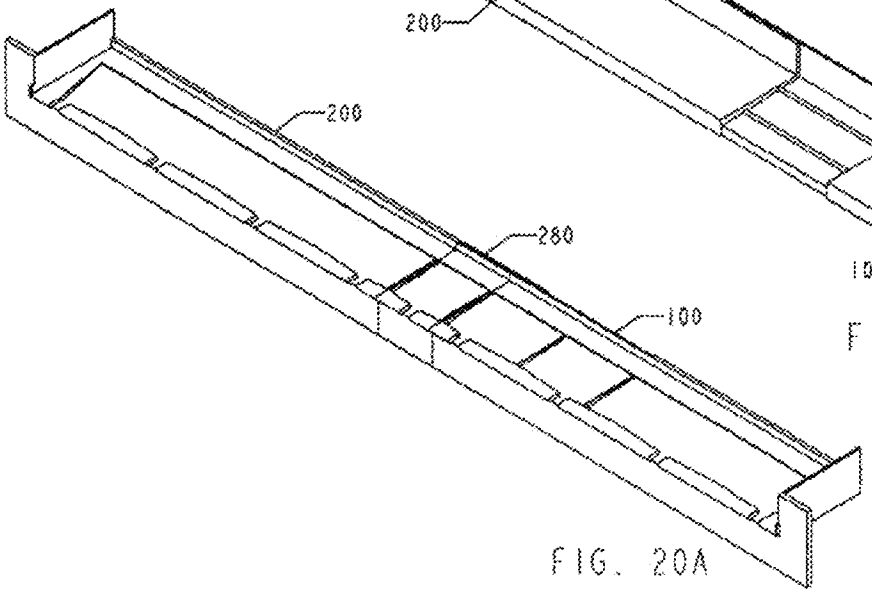
FIG. 20A is a top perspective view of an assembled two-part sliding joint sill pan flashing with a cap section.

Referring now to FIGS. 20A and 20B which are top perspective assembled and exploded views of a sill pan flashing, an optional cap section 280 may be installed over the exposed rib extensions of the second section.

Figure 21B:
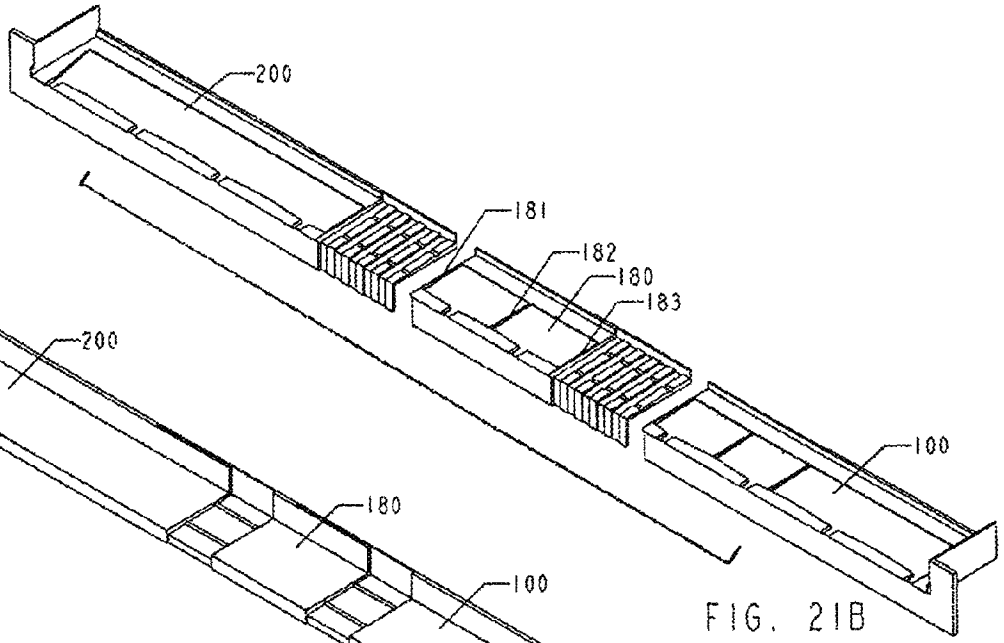
FIG. 21B is an exploded top perspective view of the sill pan flashing of FIG. 21A.
Figure 21C:
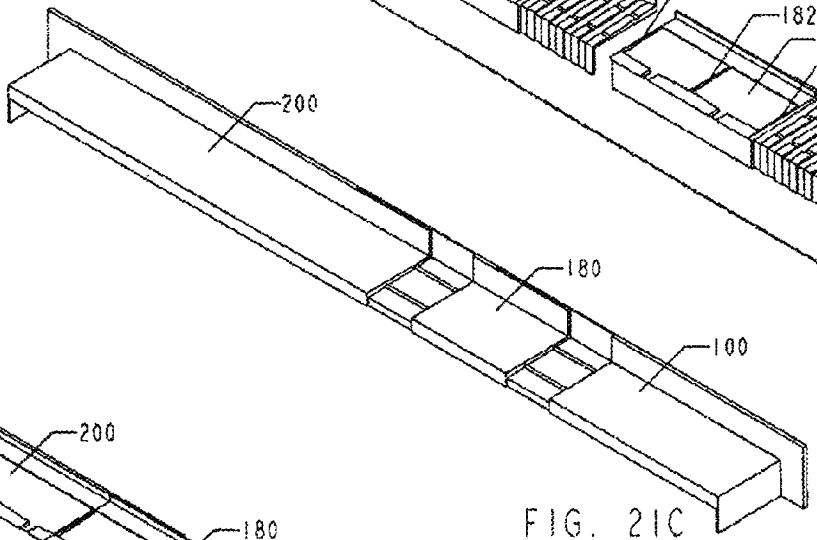
FIG. 21C is a bottom perspective view of the sill pan flashing of FIG. 21A.
Figure 21A:
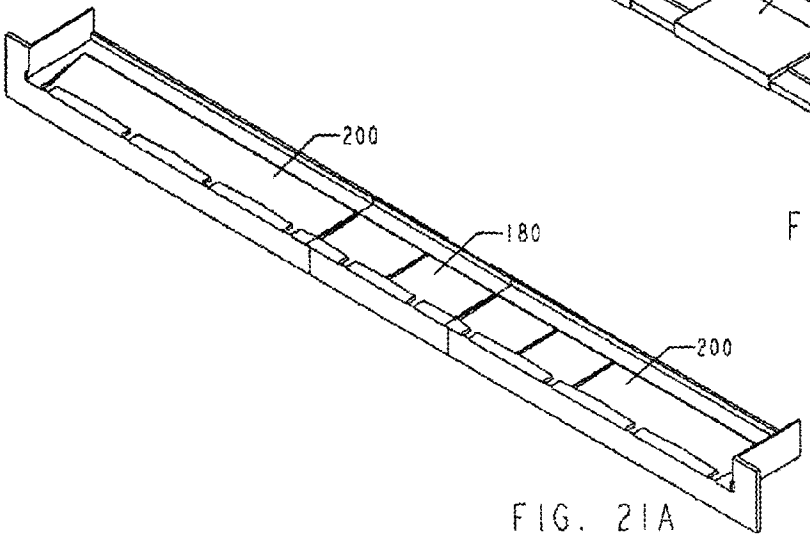
FIG. 21A is a top perspective view of an assembled two-part sliding joint sill pan flashing with a middle extension.

In this embodiment, sill pan flashings may include one or more additional middle sections such as shown in FIGS. 21A-21C. In this embodiment, each middle extension 180 has a first end, like the end of the first section, that slides over a ribbed extension; and a second end, like the end of the second section, which is a ribbed extension. Thus the sliding joints in the middle section are like the sliding joint of the two-section embodiment. The sections are preferably joined by overlapping the ends without adhesive.

In this embodiment, the adjustable sill pan flashing provides a drainable, sloped sill pan flashing for windows and doors, with a recessed slope for easy drainage and a horizontal mounting surface for windows and doors. The sliding joint design concept has a first one-piece left corner section, and a second one-piece right corner section. The first and second pieces partially slide into each other to provide an adjustable length sill pan flashing. Additional middle extensions may be inserted to allow the sill pan flashing to accommodate larger rough openings. The sliding joint design can accommodate a range of dimensions in window/door size, and in rough opening size, without cutting the pan. A further range of rough openings and standard sizes for windows and doors can be accommodated by cutting the portion of the sliding joint in the field. The sill pan flashing can be assembled quickly without glue joints or adhesives, so that the installation can be performed regardless of temperature, under any weather conditions. The parts can be made out of injection molding, or blow-molding plastic/PVC, or aluminum casting, or other materials and manufacturing methods. The preferred minimum overlap is 1.5". In this embodiment, a portion of the second section is designed to slide underneath a portion of the first section, and has a recessed slope with perpendicular ribs, to channel any water that may accumulate in the joint, or on the lower section, to the exterior of the wall cavity. There are built-in dams on the upper surfaces of all sections to prevent water from upper surfaces from spilling to a lower portion. The upper portion of all sections has a recessed slope and longitudinal ridges for installation of windows and doors, with cuts in the front ridge for drainage.

DETAILED DESCRIPTION OF EMBODIMENT

Slidable Corner Elements

Figures 23A, 23B, 23C:
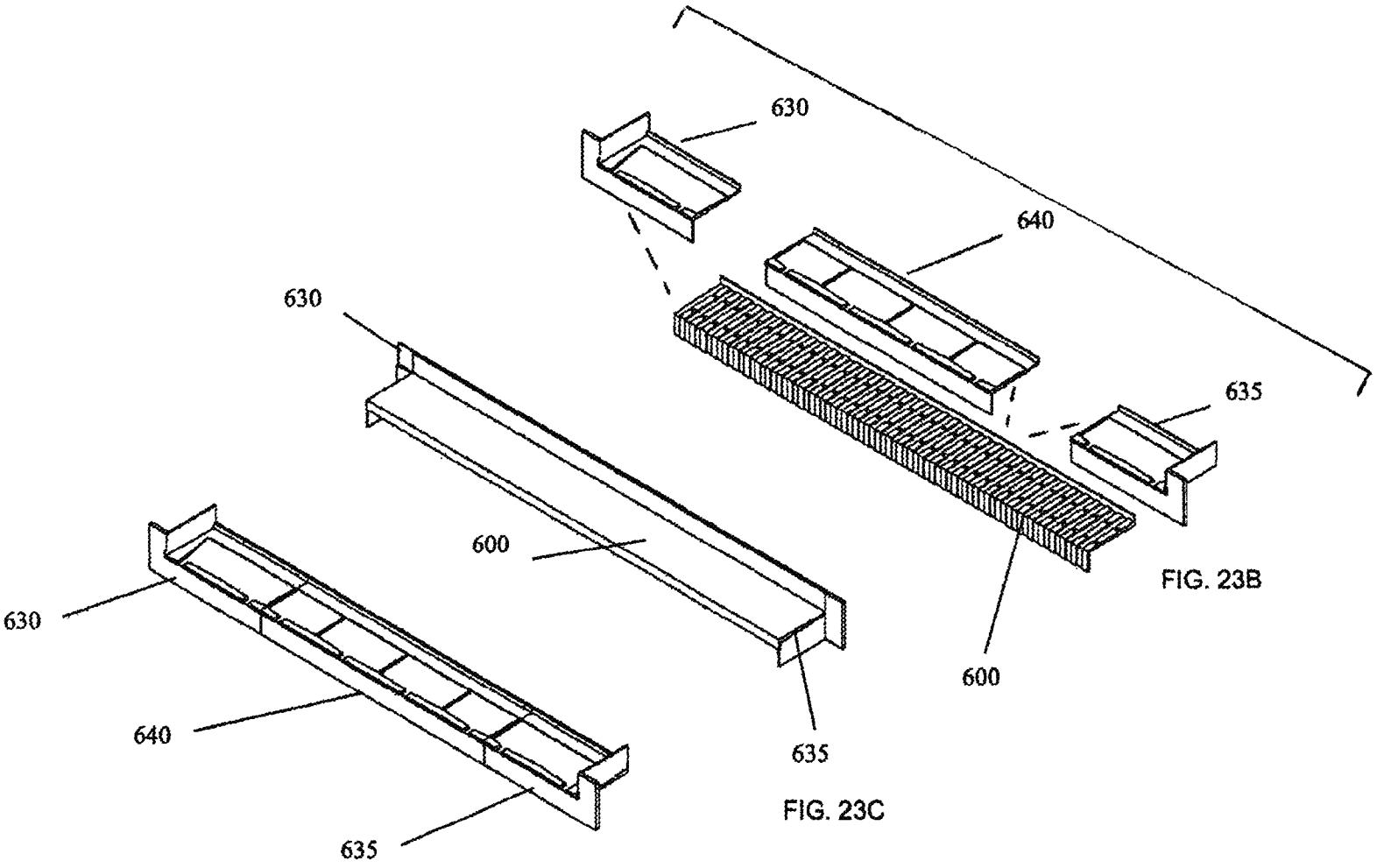
FIG. 23A is a top perspective view of an assembled adjustable sill pan flashing.
FIG. 23B is an exploded top perspective view of the sill pan flashing of FIG. 23A.
FIG. 23C is a bottom perspective view of the sill pan flashing of FIG. 23A.

FIGS. 23A-B are top perspective view of another embodiment of a slidably adjustable sill pan flashing base. In this embodiment, a left corner element 630 and a right corner element 635 fit adjustably over a base element 600. A cap element 640 may be inserted over the exposed base unit between the corner elements. FIG. 23C is a bottom perspective view od the assembled pan.

Figure 23E:
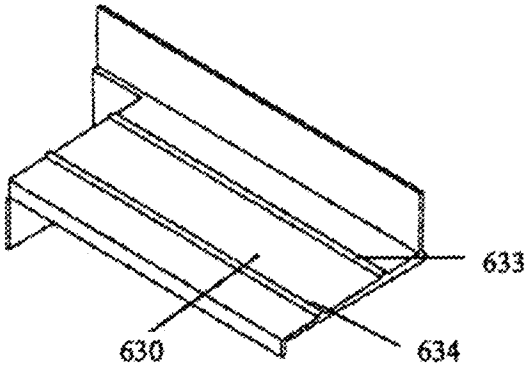
FIG. 23E is a bottom perspective view of the left corner element of FIG. 23D.
Figure 23D:
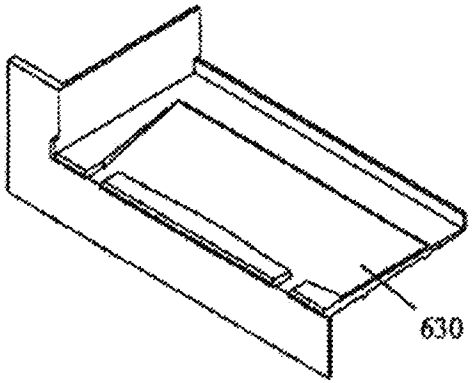
FIG. 23D is a top perspective view of a left corner element for the sill pan flashing of FIG. 23A.

FIGS. 23D-E are top and perspective views of a left corner element for the sill pan flashing of FIG. 23A. The corner element includes front and rear supports and a dam element as discussed in embodiments above. The corner element includes ribs 633 and 634 for aligning with corresponding channels in the base unit.

Figure 23G:
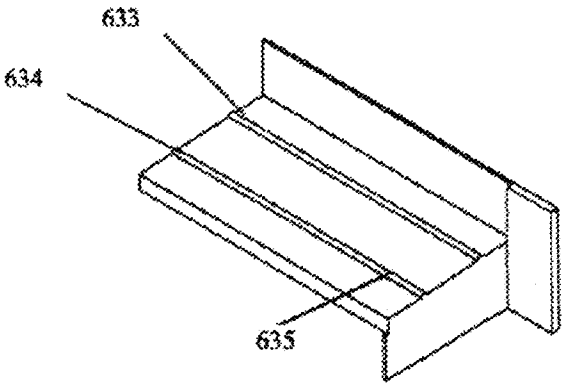
FIG. 23G is a bottom perspective view of the right corner element of FIG. 23F.
Figure 23F:
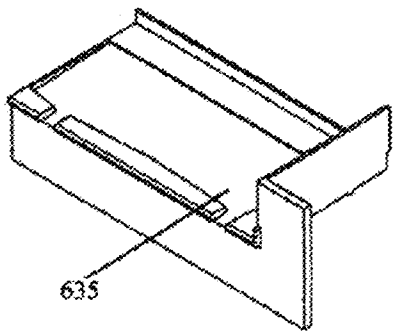
FIG. 23F is a top perspective view of a right corner element for the sill pan flashing of FIG. 23A.

FIGS. 23F-G are top and perspective views of a right corner element for the sill pan flashing of FIG. 23A. The corner element includes front and rear supports and a dam element as discussed in embodiments above. The corner element includes ribs 633 and 634 for aligning with corresponding channels in the base unit.

Figure 23I:
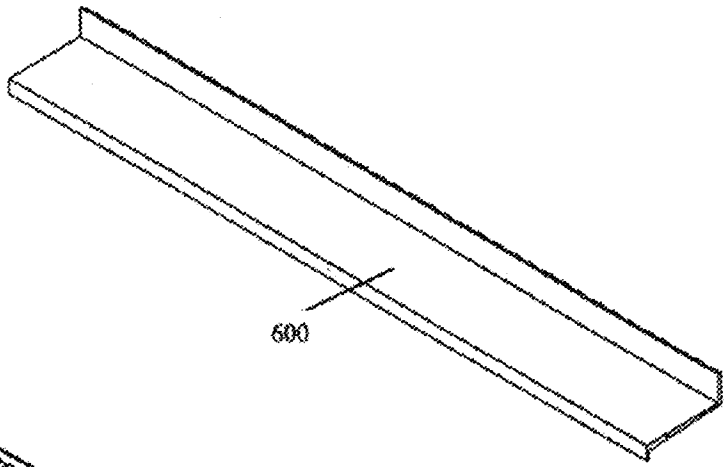
FIG. 23I is a bottom perspective view of the bottom element of FIG. 23H.
Figure 23H:
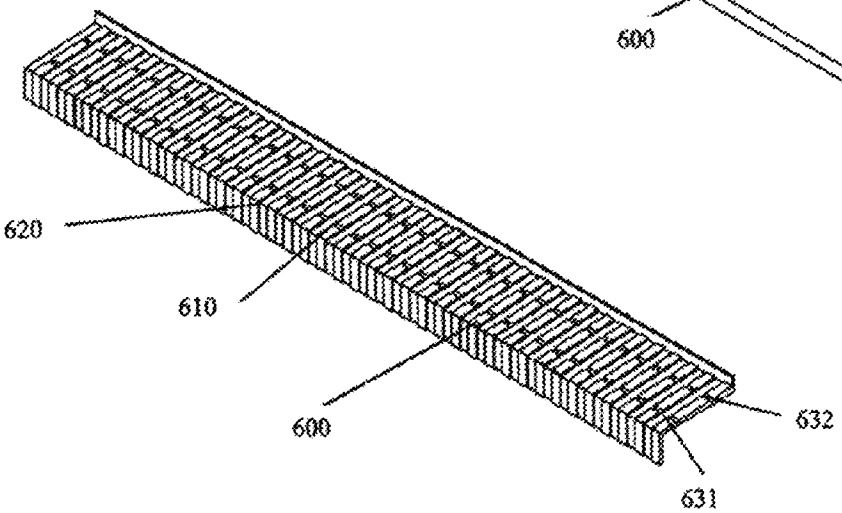
FIG. 23H is a top perspective view of a bottom element for the sill pan flashing of FIG. 23A.

FIGS. 23H-I are top and perspective views of a base unit for the sill pan flashing of FIG. 23A. The base unit includes a plurality of support ridges 610. The support ridges define base drain channels 620 which are preferably sloped toward the front of the base unit in order to draining any moisture toward the front of the sill pan flashing. The recessed surface between the support ridges may slope towards the front. In some embodiments, the support ridges may also slope to the front of the sill pan flashing. The base unit also includes channels 631 and 632 for aligning with ribs 633 and 634 of the corner sections 630 and 635.

In one embodiment, the base element is cut to a desired rough opening width after allowing for the corner sections. The base can be cut to rough opening size or slightly less.

In one embodiment, corner sections fit on top of the base unit, and no adjustment in the length of the base unit is needed due to corners. Corners should overlap the base sufficiently for the weight of windows and doors to be transferred to the structure. This assembly is easily accommodates thermal expansion or contraction of windows and doors and the wall structure, due to sliding joint design. The corner sections are then assembled on the base unit, and may be adjusted by sliding the corner sections along the ends of the base unit. The corners are preferably placed on ends of the base unit with the slide-in joint and without glue.

Figure 23K:
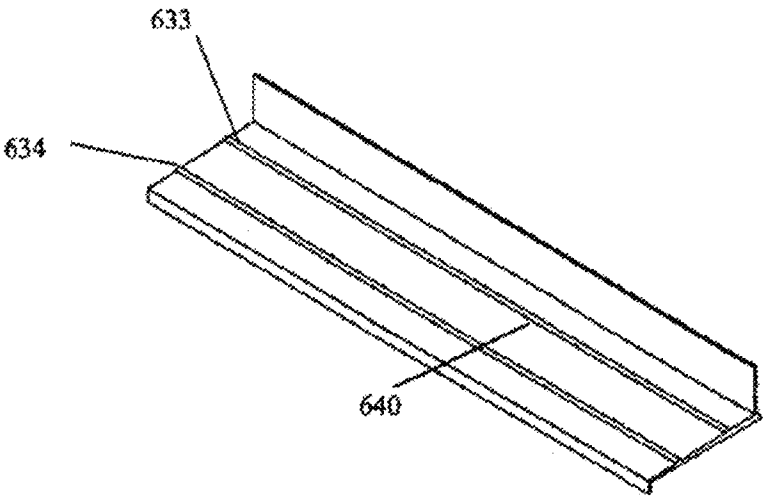
FIG. 23K is a bottom perspective view of the cap element of FIG. 23J.
Figure 23J:
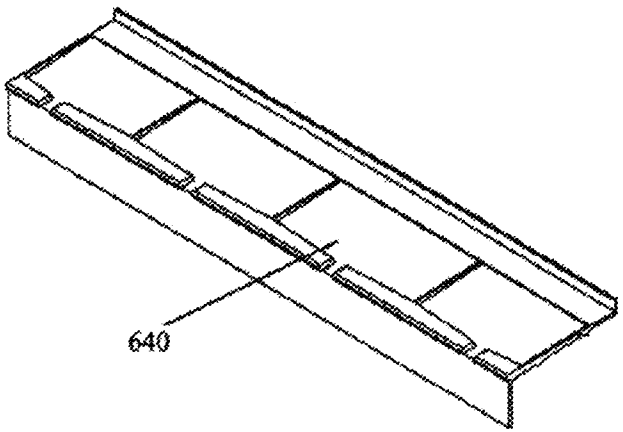
FIG. 23J is a bottom perspective view of a cap element for the sill pan flashing of FIG. 23A.
Figure 24:
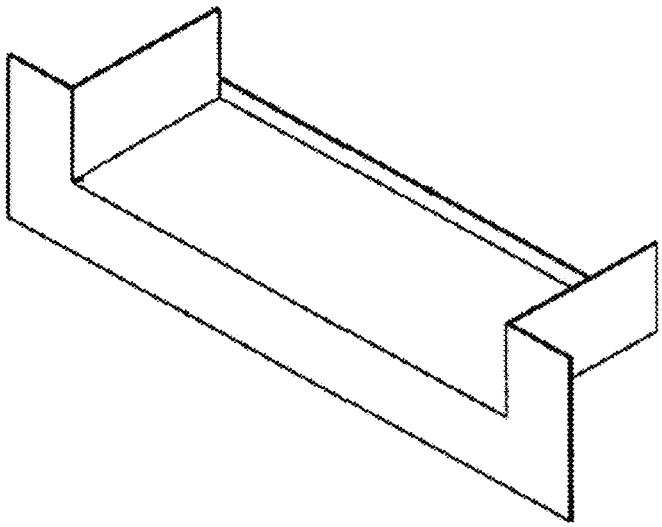
FIG. 24 (Prior Art)
FIG. 24 is a prior art perspective view of a sill pan flashing as illustrated in ASTM E 2112-07.

FIGS. 23J-K are top and perspective views of a cap element 640 for the sill pan flashing of FIG. 23A. The corner element includes front and rear supports and dam elements as discussed in embodiments above. The cap element may be cut to length to fit between the corner pieces. The cap element may include ribs 633 and 634 to snap into the channels 631 and 632 of the base unit. In some embodiments, there may be more than one base section and more then one top plate assembling the unit. For example, base section and top plate could be manufactured in 38" lengths, and then either cut to smaller size to fit the opening or multiple pieces used for wider openings. The top plate should generally be the length of the base plate minus two corners that are installed on the base plate.

DETAILED DESCRIPTION OF EMBODIMENT

Plastic Sill Pan Flashing with Rear and Front Drainage Channels

Figure 22B:
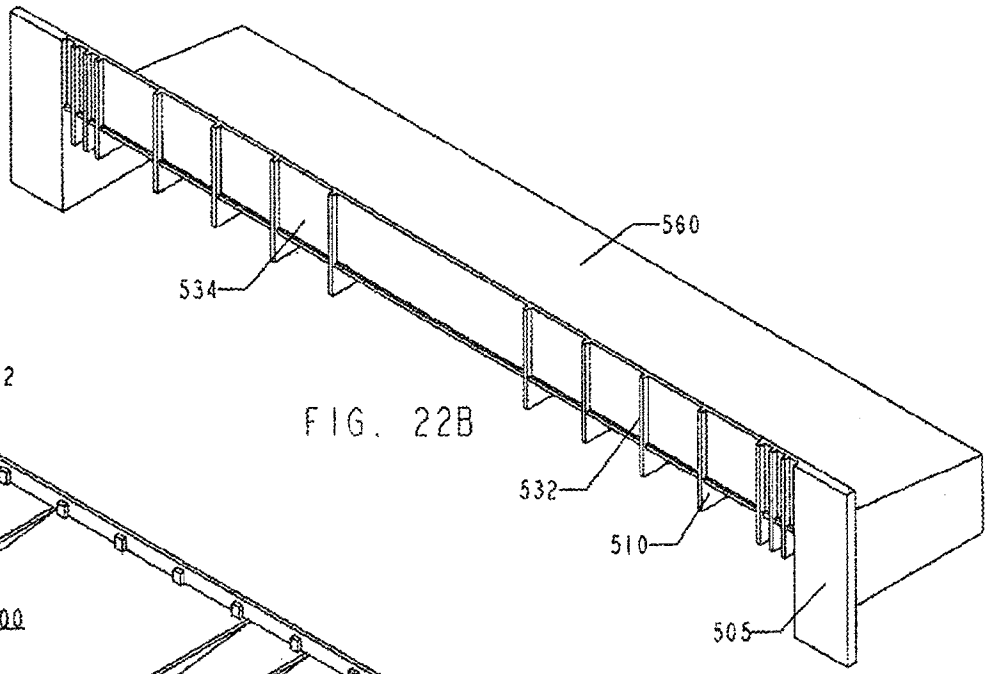
FIG. 22B is a bottom perspective view of the sill pan flashing of FIG. 22A.
Figure 22A:
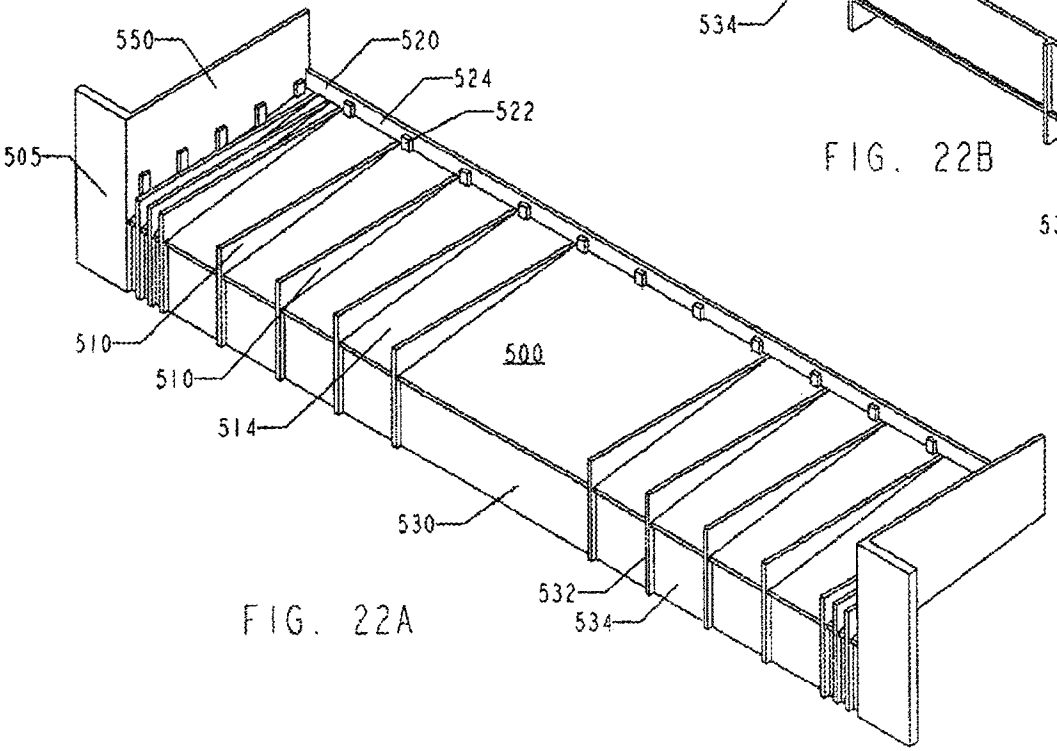
FIG. 22A is a top perspective view of an alternate embodiment of the sill pan flashing.

FIG. 22A which is a top perspective view of an alternate embodiment of the invention. In this embodiment, the sill pan flashing has a base 500 which may have a downwardly sloping top surface or a relatively flat top surface. In the case of a relatively flat top surface, a portion of the moisture that collects on the base is dissipated by evaporation. In this embodiment, the sill pan flashing has a plurality of ridge supports 510 that may be provided with a regular or an irregular spacing. Irregular spacing of the ridge supports permits more supports to be placed closer to the ends of the sill pan flashing in areas that typically bear more of a door or window load than the central portions.

The sill pan flashing includes a rear wall 520 which preferably includes offsets 522. These offsets provide rear drainage channels 524 which permit moisture to drain from the rear of the window or door through the rear drainage channels into base drainage channels 514 formed between the support ridges 510. The sill pan flashing includes a front plate 530 which extends downward from the front edge of the base. The front plate preferably includes offsets 532, which provide front drainage channels 534 for the base drainage channels 514. The combination of the rear drainage channels, the base drainage channels, and the front drainage channels provides a continuous drain path for moisture which may accumulate on the sill pan flashing.

Each end of the sill pan flashing base 500 includes a side plate 550 which may include offsets 552 (not shown) to provide side drainage channels 554 (not shown) to the base. The offsets may be angled in order to provide bracing to a molded corner section. The end pieces preferably include a front plate 505 which extends above and below the base. The sill pan flashing is typically secured to the framing by staples across the corners of the front plate 505, or by bending a nail over the front plate 505.

FIG. 22B which is a bottom perspective view of an alternate embodiment of the invention illustrates a flat base 560 for the sill pan flashing.

DETAILED DESCRIPTION OF EMBODIMENT

Plastic Sill Pan Flashing with Extension Couplers

FIGS. 25-28 are side perspective views of example extension couplers 701, 702, 703, and 704 respectively. Each extension coupler can be used to join end sections of sill pan flashing base sections in order to provide a desired length of the sill pan.

Figure 25:
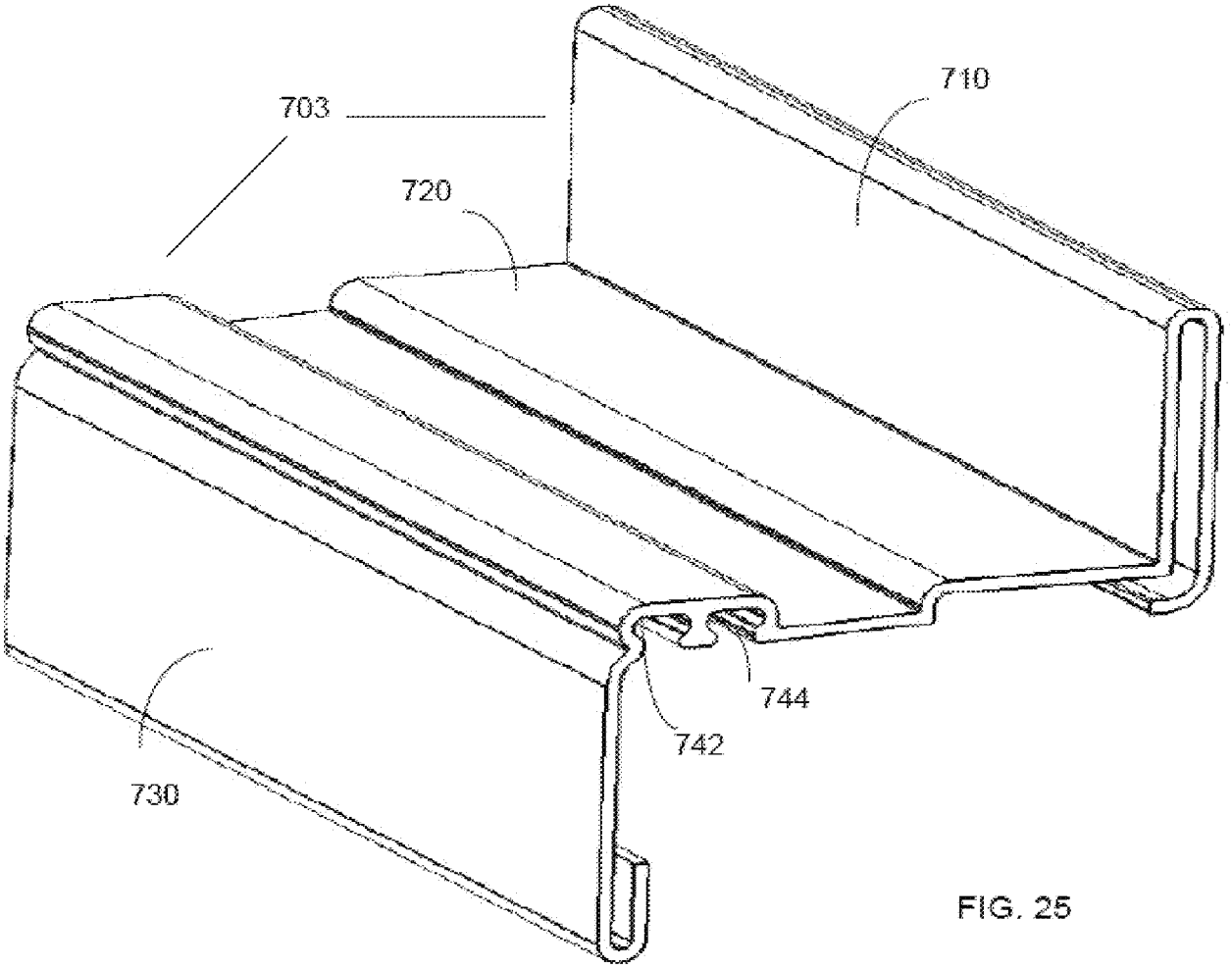
FIG. 25 is a side perspective view of an example embodiment of an extension coupler.

FIG. 25 shows a narrow extension coupler 703 with a base section rear wall overlap 710; a rear support 720; a front support pedestal with recesses 742 and 743; and a base section front lip overlap 730.

In one example, the extension coupler is formed by cutting an extrusion to about a 5 inch length. The extension coupler has a thickness of about 1/16 to 1/8 inch. The extension coupler is inserted over the ends of two sill pan flashing base sections so that the extension coupler covers at least 1 inch of each of the two sill pan flashing base section ends. In this example, the extension coupler permits an adjustment in the overall length of the two base sections ranging from a first length with the minimum overlap to a length 2-3 inches shorter as the two ends are brought closer together under the extension coupler. The extension coupler is typically glued to the two sill pan flashing base section ends with PVC cement to create a waterproof and strong joint.

Figure 26:
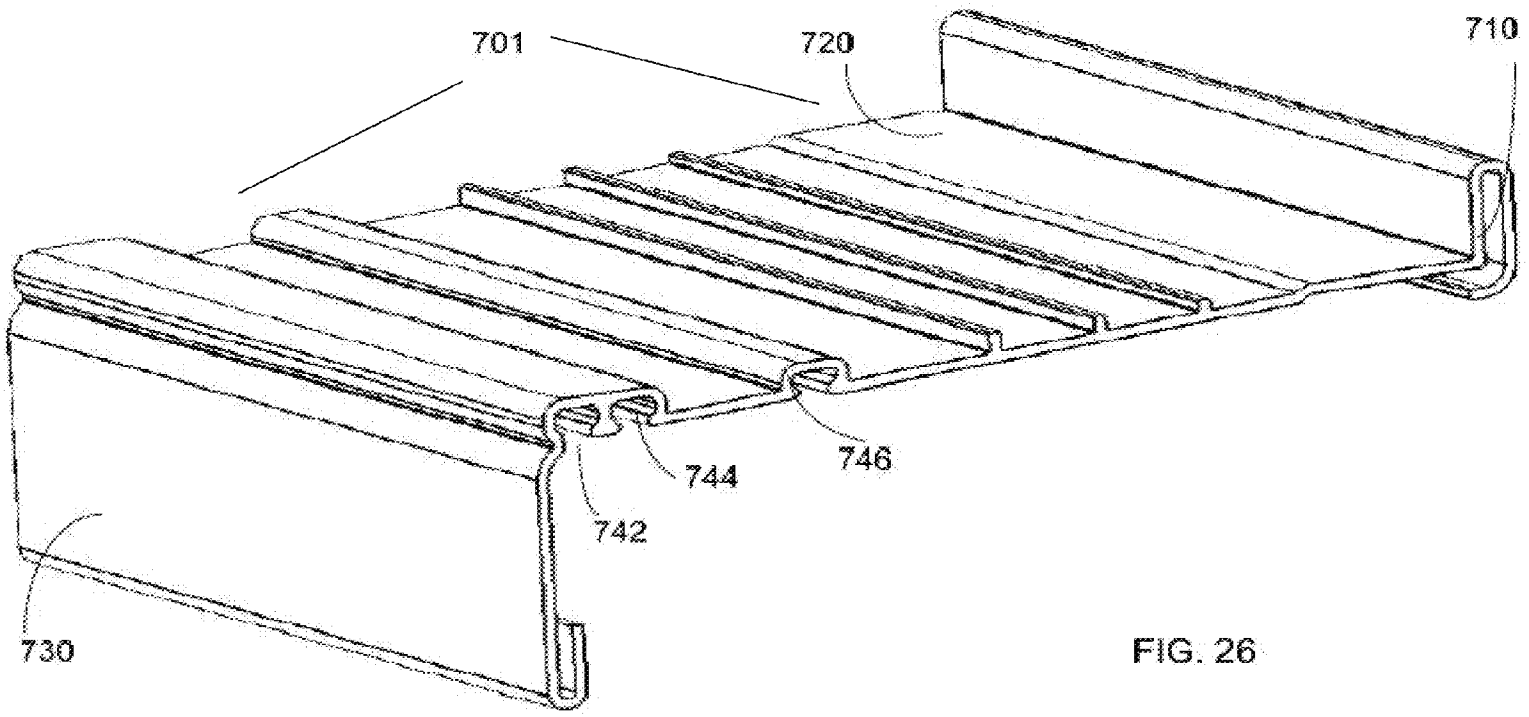
FIG. 26 is a side perspective view of another example embodiment of an extension coupler.

FIG. 26 shows an extension coupler 701 with a base section rear wall overlap 710; a rear support 720; a front support pedestal with recesses 742 and 743; an intermediate support with recess 746; and a base section front lip overlap 730.

Figure 27:
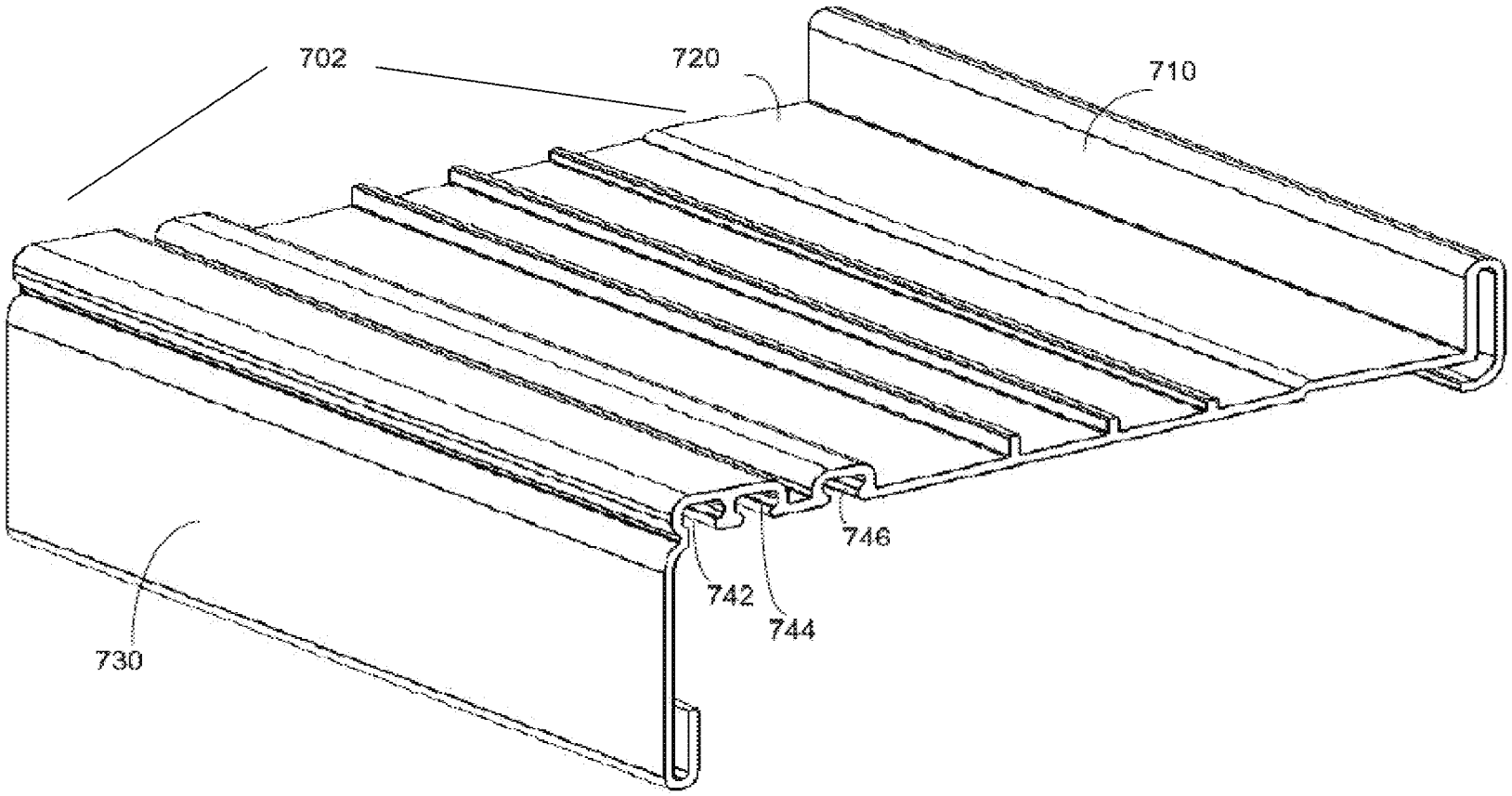
FIG. 27 is a side perspective view of another example embodiment of an extension coupler.

FIG. 27 shows an extension coupler 702 with a base section rear wall overlap 710; a rear support 720; a first front support pedestal with recesses 742 and 743; a second front support pedestal with recess 746; and a base section front lip overlap 730.

Figure 28:
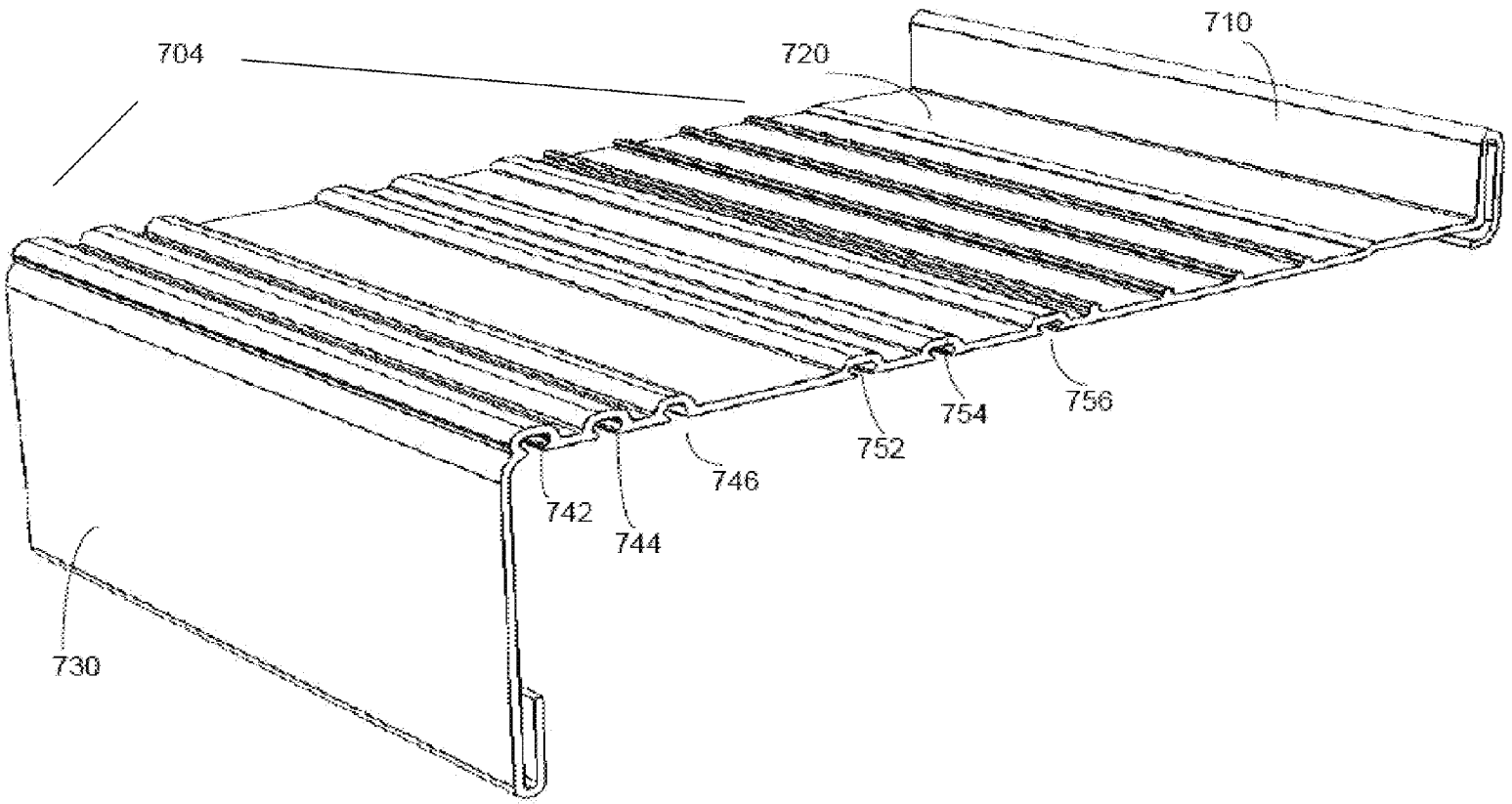
FIG. 28 is a side perspective views of another example embodiment of an extension coupler.

FIG. 28 shows a wide extension coupler 704 with a base section rear wall overlap 710; a rear support 720; a first front support pedestal with recesses 742 and 743; a second front support pedestal with recess 746; intermediate support pedestals with recesses 752, 754, and 756; and a base section front lip overlap 730.

Figure 29:
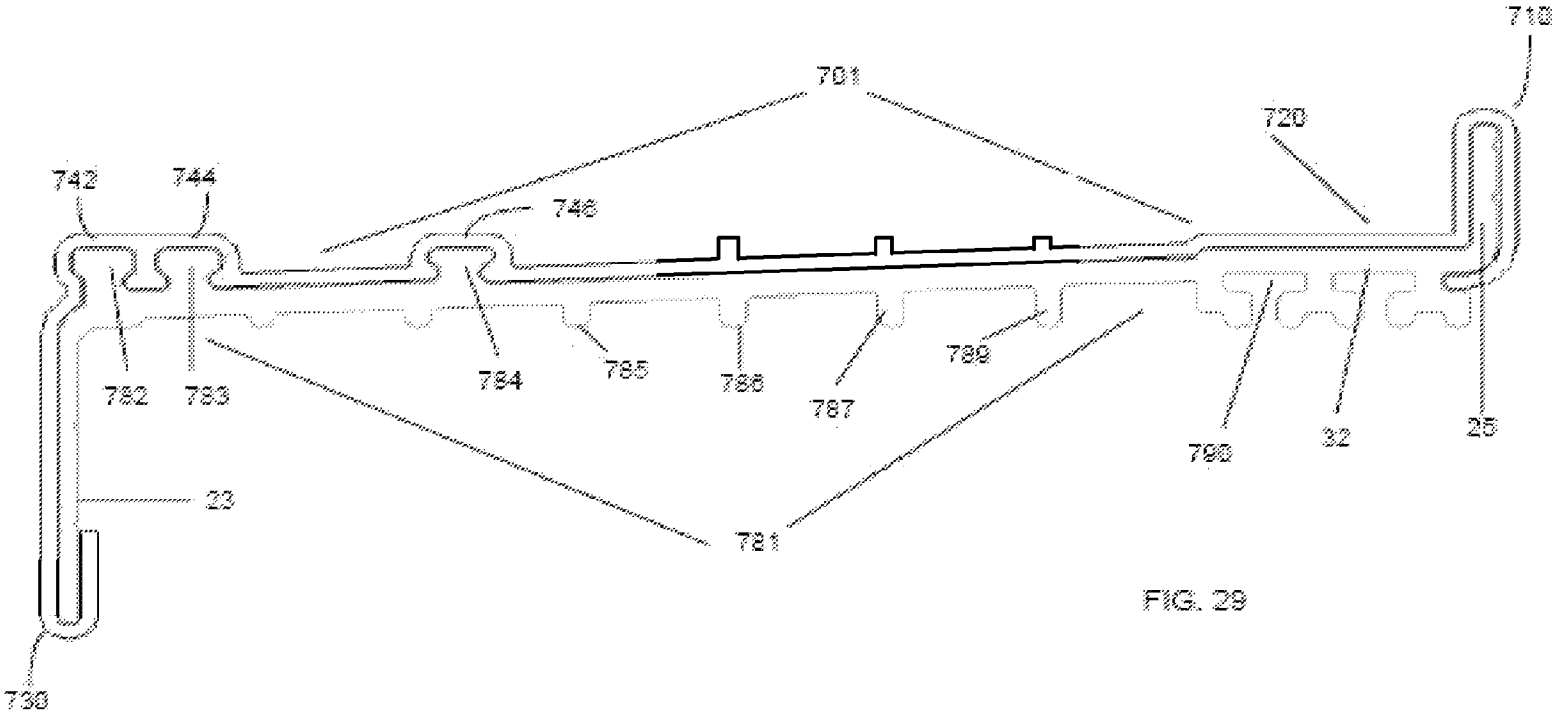
FIG. 29 is a side cross section views of an extension coupler engaging a sill pan flashing base.

FIG. 29 is a side cross section view of an extension coupler 701 engaging a sill pan flashing base 781. In this example, the sill pan flashing base 781 includes a rear wall 25; a rear support ridge 32, front supports 782 and 783; an intermediate support 784; example base support ribs 785, 786, 787, and 789; and a downwardly extending front lip 23. In this example, the rear support ridge includes cutout features such as 790 for accepting a portion of an end cap; and an end cap may also engage the front supports 782 and 783, as well as engaging the intermediate support 784. In other examples, as described below, an extendable self adhering flashing (ESAF) may be used to seal the ends of the flashing base to the bottom side corners of a rough opening.

In FIG. 29, the example extension coupler 701 mates with and slides with respect to the sill pan flashing base 781, so that the rear wall overlap 710 wraps around the sill pan flashing base rear wall 25 and the front lip overlap 710 wraps around the sill pan flashing base front lip 23. In this example, a front support includes portions 742 and 744 which engage the sill pan flashing base front supports 782 and 783; and the intermediate support 746 engages the sill pan flashing base intermediate support 784.

Figure 33:
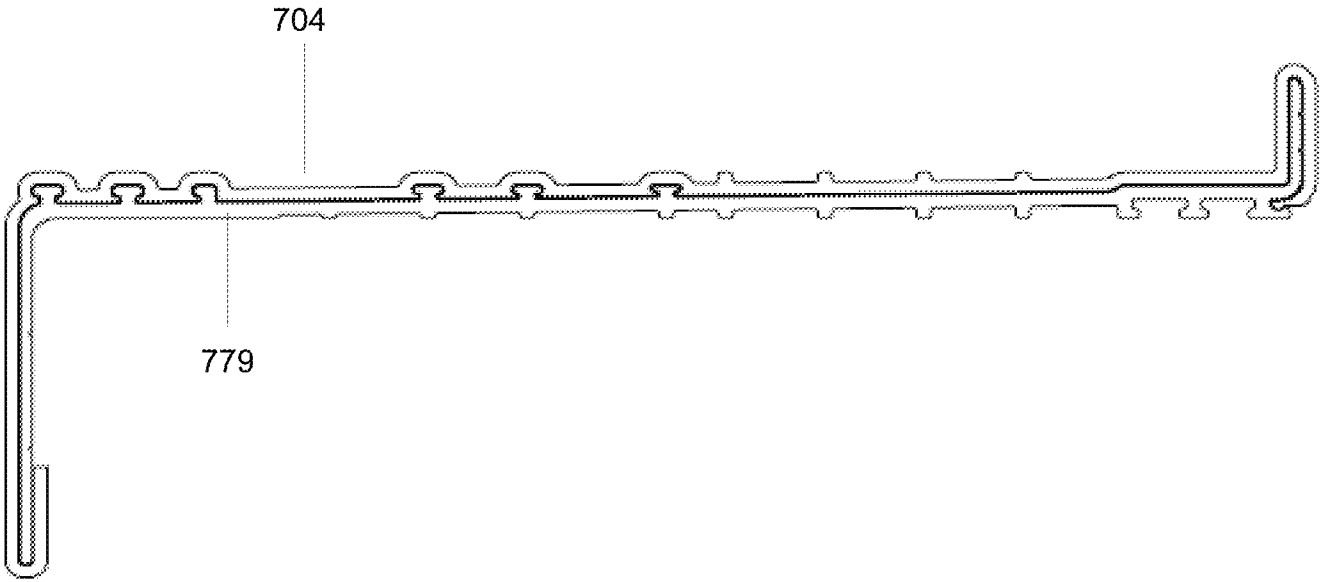
FIG. 33 is a side cross section views of an extension coupler engaging a sill pan flashing base.

FIG. 33 is a side cross section views of an extension coupler 704 engaging a 6⁹⁄₁₆ inch wide sill pan flashing base 779.

Figures 30A, 30B, 30C, 30D:
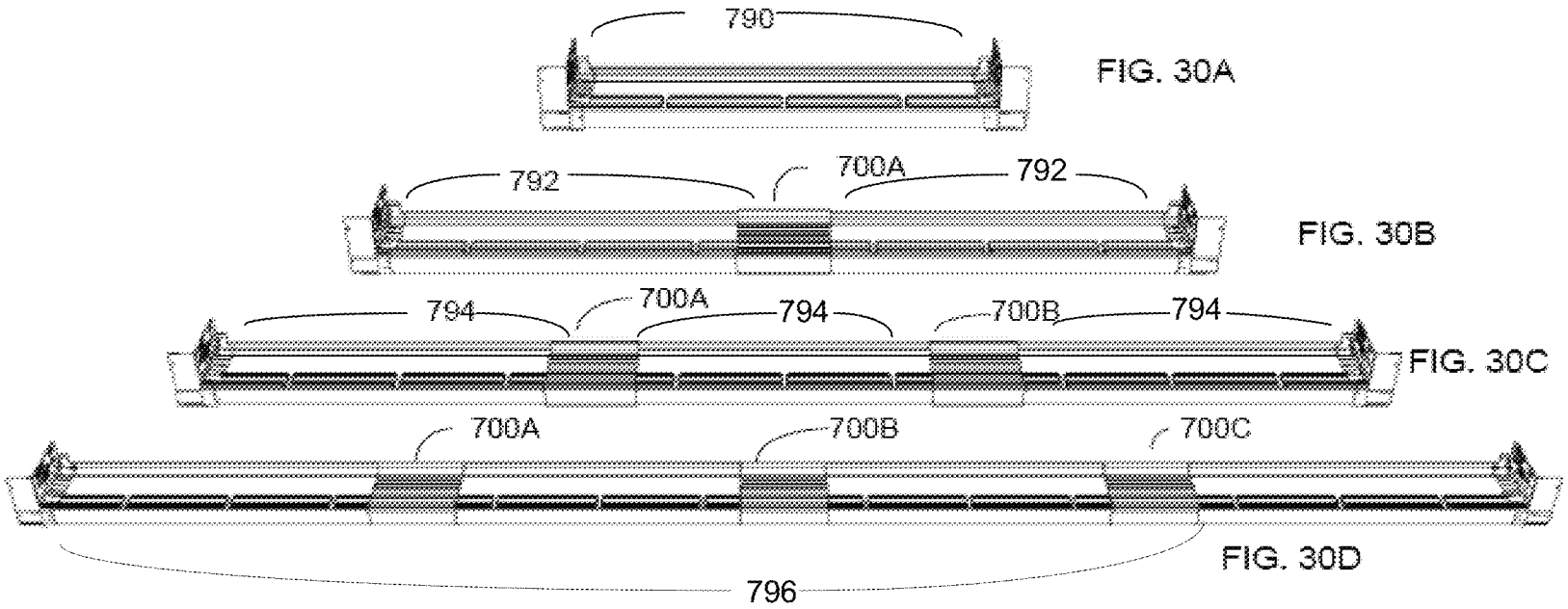
FIGS. 30A-30D are top perspective view of example assembled sill pan flashing bases with extension couplers.

FIGS. 30A-30D are top view of example assembled sill pan flashing with extension couplers as required. FIG. 30A shows a 40 inch long sill pan flashing without an extension coupler. FIG. 30B shows an 80-82 inch long sill pan flashing with a first extension coupler 700A. FIG. 30C shows an 120-124 inch long sill pan flashing with a first extension coupler 700A and a second extension coupler 700B. FIG. 30D shows a 160-168 inch long sill pan flashing with three extension couplers 700A, 700B, and 700C. In these examples. each extension coupler provides about two inches of sill pan flashing length adjustment. In these examples, each extension coupler may overlap base sections where the ends abut, or may overlap base sections where the ends of the base sections are spaced about 2 inches apart.

DETAILED DESCRIPTION OF EMBODIMENT

Variable Size Plastic Sill Pan Flashing with Extension Couplers

In this embodiment, the sill pan flashing base flashing is assembled to a desired width as described in copending U.S. patent application Ser. No. 12/896,935 which is incorporated by reference herein. For example, the sill pan flashing base is provided with the ability to use either a maximum width as provided; or to break off the front lip and a portion of the front of the sill pan flashing base flashing to a desired width an inserting a replacement front lip. Referring to FIG. 29, the front lip 23 may be integral to the sill pan flashing base, or the front lip may be a replacement front lip inserted into a recess (not shown) in the front of the sill pan flashing base 781.

DETAILED DESCRIPTION OF EMBODIMENT

Plastic Sill Pan Flashing with Flexible Ends Caps

There are several approaches to creating a watertight seal between a window or door rough opening and the sill pan flashing base. In several examples described above, separate end caps are affixed to a sill pan flashing base which has been cut to a desired length. In other examples, fixed end caps are provided for telescoping sill pan flashing base sections. In other examples, such as illustrated in FIGS. 30B-30D, fixed end caps are provided on the outside sill pan flashing base sections, and one or more adjustable extension coupler is used to join sill pan flashing base sections.

In this embodiment, one or more sill pan flashing base sections are provided without end caps, the sill pan flashing base sections are cut or assembled, such as with extension couplers to extend across the bottom of a window or door rough opening, and extendable self adhering flashing (ESAF) is used to seal the bottom rough opening corners. ESAF is typically created by applying adhesive (such as latex, asphalt or butyl) on extendable film. The extendable film is typically "wrinkled" prior to adhesive being applied so it can stretch with the adhesive and form around different shapes, such as arches and corners without breaking the film. Examples of ESAF include DuPont™ FlexWrap™ by DuPont™, ProtectoFlex™ by Protecto Wrap Co., ProSAFfleX™ by Schnee-Morehead, and other products.

Figure 31:
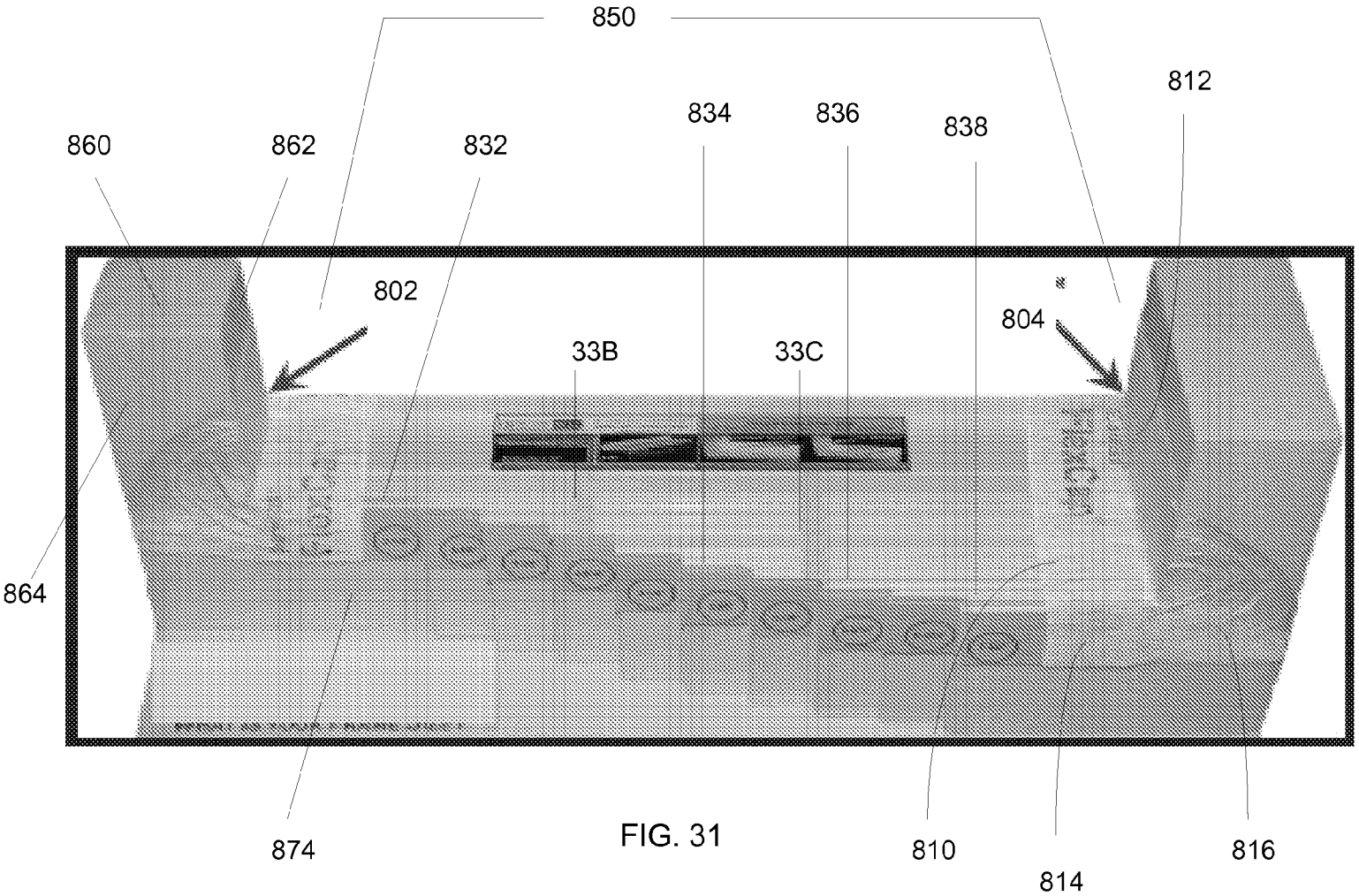
FIG. 31 is a top perspective view of a demonstration model representing a rough opening with a sill pan flashing base section installed in the bottom of the rough opening.

FIG. 31 is a top perspective view of a demonstration model representing a rough opening 850 with a sill pan flashing base section such as 832, 834, 836, or 838 installed in the bottom of the rough opening; a first ESAF flashing element 802 installed in one bottom rough opening corner; and a second ESAF flashing element 804 installed in one bottom rough opening corner.

In this example, the sill pan flashing base section is a variable size element where any of 11 different widths of the base section may be created as described in copending U.S. patent application Ser. No. 12/896,935 which is incorporated by reference herein. In FIG. 31, one end of the demonstration unit, covered by the second ESAF flashing element 804, has a wide sill pan flashing base section 838; and the other end, covered by the first ESAF flashing element 802, has a narrow sill pan flashing base section.

In this example, the sill pan flashing base section includes drainage channels 33B and 33C. The first ESAF flashing element 802 covers or partially covers another drainage channel 33A (not shown); and the second ESAF flashing element 804 covers or partially covers another drainage channel 33*d* (not shown).

Element 860 represents a first rough opening side framing member. Element 862 represents the inside surface of a first side rough opening. Element 864 represents the outside of a first side rough opening. Element 874 represents the outside of the bottom rough opening. Elements 864 and 874 are typically portions of exterior sheathing secured to the rough opening framing members.

Element 804 may be a single sheet of ESAF flashing, such that a portion 810 of the ESAF flashing is applied to the end portion of the sill pan flashing base section; a portion 812 of the ESAF flashing is applied to the inside of the rough opening; a portion 814 of the ESAF flashing is folded down and adhered to the outside of the bottom rough opening; and a portion 816 of the ESAF flashing is folded over and adhered to the outside of the side rough opening.

FIGS. 32A-32M represent an example installation of ESAF flashing over a sill pan flashing.

FIG. 32A shows a rough opening 850. A drainage skirt, such as a 12 inch waterproofing membrane is installed over the bottom plate of the rough opening. Five ⅜ inch beads of a sealant 890, such as Henkel/OSI TeQ, are applied to the bottom, bottom corners, and outside bottom of the rough opening as illustrated in FIGS. 32A-32B.

A sill pan flashing base, such as 16, 300, 600, 780, or 781 is cut or formed to a length ¼ inch less than the length of the rough opening and positioned over the sealant beads as shown in FIGS. 32C-32E. The sill pan flashing base may have multiple sections and extension couplers. Fasteners 778 may be applied to the sill pan flashing base in proximity to the rough opening corners. Drainage channels 33A and 33B are preferably provided near, but no closer than 2 inches from, the rough opening corners.

FIG. 32F shows ESAF flashing sheets applied to the bottom corners. FIG. 32G is a detailed view of a first ESAF flashing sheet 803 with a first portion 810 of the ESAF flashing applied over the end portion of the sill pan flashing base section, and over at least a portion of the drainage channel 33A; and a second portion 812 of the ESAF flashing applied over the side of the rough opening. In this step, the ESAF sheets are adhered to the faces of the rough opening studs. The term "stud" refers to any wood, metal, concrete or other material of construction used to form the rough opening.

FIG. 32H shows ESAF flashing sheets folded over the outside side and bottom of the rough opening corners. FIG. 32I is a detailed view of a first ESAF flashing sheet 803 with a portion 814 folded down over the front lip and adhered to the outside of the bottom rough opening; and a portion 816 folded over and adhered to the outside of the side rough opening. The folded flashing portions preferably extend at least 2-3 inches over the rough opening side, and 2-3 inches over the sill pan flashing front lip. The rough opening typically comprises a sheathing material installed over the outside of the rough opening studs, and a portion of each ESAF sheet is folded over a portion of the outside of the sheathing material in order to prevent moisture from infiltrating between the sheathing and the studs at the bottom corners of the rough opening. The ESAF sheets are typically wrapped over a portion of the interior facing portion of the studs so that the interior wall covering is placed over the ESAF sheets.

FIGS. 32J-32K show ⅜ inch beads 892 of sealant applied to the edges of the ESAF flashing.

FIGS. 32J-32K show the ESAF flashing sheets folded over the rear wall 818 of the sill pan flashing base, and folded around the rough opening side 819. In this step, portions of the ESAF sheets are folded and adhered to the interior sides of the rough opening studs and to back wall of the sill pan flashing base. The interior wall covering will be placed over the interior portions of the ESAF sheets. This step completes the formation of end dams for the rough opening corners between the back wall and the rough opening studs which prevent water infiltration into the interior portion of the bottom corner. Moisture detained by these dams can gravity drain through drain channels.

This embodiment combines the structural support and sealing advantages of a pre-manufactured sloped sill pan with the installation efficiencies and economy of ESAF. This approach reduces the overall cost of the sill pan flashing assembly, and avoids the cost of inventory of pre-manufactured end caps for various depth sill pans. It also avoids the use of bonding agent to bond pre-manufactured end caps to the middle section because ESAF already has adhesive on it so which would bond to middle section.

This embodiment also avoids another bonding agent or other product that would typically seal between the pre-manufactured End Cap and the rough opening. In addition, this embodiment avoids expenses on engineering and tooling for pre-manufactured end caps, frequently made by injection molding.

The sill pan flashing base is preferably installed plumb and level in the rough opening. One advantage of this approach is that window or door installation is simplified by leveling the middle section rather than having to shim the window or door. The sill pan flashing base comprises a back lip, a sloped base which is higher in the back than the front, and a plurality of drain channels. The middle section preferably comprises one or more lengthwise-oriented front supports and rear support, such that the front supports and the rear support provide a level support for a window or door. The lengthwise-oriented front supports provide near-continuous support for the window or door and permit an economical fabrication by extrusion. The drain channels permit water to drain through the front supports.

What is claimed is:

1. A sill pan flashing system to protect the rough opening of a window or door from water intrusion, the sill pan flashing system comprising a first sill pan flashing base section comprising
- a first end,
- a second end
- a sloped upper portion,
- a rear wall,
- a front flange,
- a lengthwise oriented rear sill support, and
- a lengthwise oriented front sill support comprising a plurality of drain gaps, the lengthwise oriented front sill support comprising a plurality of lengthwise oriented support pedestals; and a second sill pan flashing base section comprising
- a first end,
- a second end
- a sloped upper portion,
- a rear wall,
- a front flange,
- a lengthwise oriented rear sill support, and
- a lengthwise oriented front sill support comprising a plurality of drain gaps, and a first extension coupler placed over the first end of the first sill pan flashing base section and the second end of the second sill pan flashing base section, the first extension coupler comprising
- a base section comprising a rear support and a front support, the base section having a rear portion and a front portion,
- a rear wall overlap along the rear portion of the base section, and
- a front lip overlap along the front portion of the base section,
- the first extension coupler comprising recesses to engage the plurality of lengthwise oriented support pedestals of the first sill pan flashing base section; and a window or door with a window or door sill supported by the lengthwise oriented rear sill support and lengthwise oriented front sill support of the sill pan flashing.

2. The sill pan flashing of claim 1 wherein the first and second sill pan flashing base sections and the first extension coupler are constructed of a plastic.

3. The sill pan flashing system of claim 1 further comprising a third sill pan flashing base section comprising
- a first end,
- a second end
- a sloped upper portion,
- a rear wall,
- a front flange,
- a lengthwise oriented rear sill support, and
- a lengthwise oriented front sill support comprising a plurality of drain gaps; and a second extension coupler placed over the first end of the second sill pan flashing base section and the second end of the third sill pan flashing base section, the second extension coupler comprising
- a base section rear wall overlap,
- a rear support,
- a front support, and
- a base section front lip overlap.

4. The sill pan flashing system of claim 1 further comprising a plurality of additional sill pan flashing base sections; and a plurality of additional extension couplers.

5. A method for installing a sill pan flashing system to protect the rough opening of a window or door from water intrusion, the rough opening comprising a bottom, a first side, and a second side, the method comprising determining the length of the rough opening;

providing a plurality of sill pan flashing base sections, each sill pan flashing base section comprising a first end, a second end a sloped upper portion, a rear wall, a front flange, a lengthwise oriented rear sill support, and a lengthwise oriented front sill support comprising a plurality of drain gaps, the lengthwise oriented front sill support comprising a plurality of lengthwise oriented support pedestals;

providing extension couplers comprising a base section comprising a rear support and a front support, the base section having a rear portion and a front portion, a rear wall overlap along the rear portion of the base section, and a front lip overlap along the front portion of the base section, the first extension coupler comprising recesses to engage the plurality of lengthwise oriented support pedestals of the first sill pan flashing base section; and creating a sill pan flashing base assembly by cutting, if necessary, one or more of the sill pan flashing base sections, configuring the plurality of sill pan flashing base sections and extension couplers to cover the length of the rough opening, and assembling the plurality of sill pan flashing base sections and extension couplers by gluing the extension couplers to adjacent ends of the sill pan flashing base sections.

6. The method of claim 5 further comprising sliding the adjacent ends of the sill pan flashing base sections relative to the extension couplers in order to adjust the length of the sill pan flashing base assembly.

* * * * *